US010351382B2

(12) United States Patent
Moriya et al.

(10) Patent No.: US 10,351,382 B2
(45) Date of Patent: Jul. 16, 2019

(54) SHEET PROCESSING APPARATUS AND IMAGE FORMING SYSTEM

(71) Applicant: CANON FINETECH NISCA INC., Misato-shi (JP)

(72) Inventors: Shintaro Moriya, Minamikoma-gun (JP); Kazuhiko Watanabe, Minamikoma-gun (JP); Hiroshi Amano, Minamikoma-gun (JP); Seiji Ono, Minamikoma-gun (JP); Ichiro Yoda, Minamikoma-gun (JP); Masao Ueno, Minamikoma-gun (JP)

(73) Assignee: Canon Finetech Nisca Inc., Misato-shi (JP)

( * ) Notice: Subject to any disclaimer, the term of this patent is extended or adjusted under 35 U.S.C. 154(b) by 0 days.

(21) Appl. No.: 15/428,168

(22) Filed: Feb. 9, 2017

(65) Prior Publication Data

US 2017/0240377 A1 Aug. 24, 2017

(30) Foreign Application Priority Data

Feb. 22, 2016 (JP) ..... 2016-031063

(51) Int. Cl.
*B65H 31/34* (2006.01)
*B65H 29/20* (2006.01)
(Continued)

(52) U.S. Cl.
CPC ..... *B65H 31/34* (2013.01); *B65H 29/145* (2013.01); *B65H 29/20* (2013.01); *B65H 31/02* (2013.01);
(Continued)

(58) Field of Classification Search
CPC ... B65H 7/00; B65H 7/02; B65H 7/14; B65H 7/20; B65H 29/00; B65H 29/20;
(Continued)

(56) References Cited

U.S. PATENT DOCUMENTS 8,528,898 B2 9/2013 Kushida
9,604,479 B2 3/2017 Kokura
(Continued)

FOREIGN PATENT DOCUMENTS

JP 2004-277094 A 10/2004
JP 2009-120333 A 6/2009
(Continued)

OTHER PUBLICATIONS

U.S. Appl. No. 15/359,755, filed Nov. 23, 2016, first named inventor: Shintaro Moriya.
(Continued)

*Primary Examiner* — Prasad V Gokhale
(74) *Attorney, Agent, or Firm* — Venable LLP

(57) ABSTRACT

Provided is a sheet processing apparatus, including: a placement portion to which a sheet conveyed by a conveyance portion in a conveyance direction is placed; a processing portion configured to perform predetermined processing on a sheet placed on the placement portion, and to be movable in a predetermined moving range; and a control portion configured to control the processing portion to position, at a timing at which a sheet conveyed by the conveyance portion passes through the moving range, from a first position of preventing from interfering with the sheet to a second position of performing the predetermined processing on a preceding sheet having been conveyed by the conveyance portion and placed on the placement portion before the sheet.

13 Claims, 20 Drawing Sheets

(51) Int. Cl.

| | |
|---|---|
| ***B65H 31/08*** | (2006.01) |
| ***B65H 43/00*** | (2006.01) |
| ***G03G 15/00*** | (2006.01) |
| ***B65H 29/14*** | (2006.01) |
| ***B65H 31/02*** | (2006.01) |
| ***B65H 31/36*** | (2006.01) |
| ***B65H 31/38*** | (2006.01) |
| ***B65H 33/08*** | (2006.01) |

(52) U.S. Cl.
CPC ..... *B65H 31/08* (2013.01); *B65H 31/36* (2013.01); *B65H 31/38* (2013.01); *B65H 33/08* (2013.01); *B65H 43/00* (2013.01); *G03G 15/6529* (2013.01); *G03G 15/6544* (2013.01); *B65H 2301/4212* (2013.01); *B65H 2301/4213* (2013.01); *B65H 2403/942* (2013.01); *B65H 2404/1521* (2013.01); *B65H 2405/11151* (2013.01); *B65H 2511/12* (2013.01); *B65H 2511/51* (2013.01); *B65H 2513/50* (2013.01); *B65H 2601/2525* (2013.01); *B65H 2801/27* (2013.01); *G03G 2215/00827* (2013.01)

(58) Field of Classification Search
CPC ..... B65H 29/22; B65H 29/60; B65H 29/62; B65H 31/20; B65H 31/34; B65H 2405/11425; B65H 2408/1142; B65H 2511/12; G03G 2215/00827
USPC ..... 271/221, 223
See application file for complete search history.

(56) References Cited

U.S. PATENT DOCUMENTS

| | | | | |
|---|---|---|---|---|
| 10,124,977 | B2 * | 11/2018 | Moriya | G03G 15/6544 |
| 2011/0062647 | A1 * | 3/2011 | Tsuchiya | B42B 4/00 270/58.09 |
| 2011/0081185 | A1 * | 4/2011 | Motoi | B65H 29/60 399/407 |
| 2011/0215519 | A1 * | 9/2011 | Sugizaki | B65H 29/20 271/208 |
| 2015/0321870 | A1 * | 11/2015 | Okamoto | H05K 999/99 358/1.12 |
| 2017/0036880 | A1 * | 2/2017 | Tokuma | B65H 45/18 |
| 2017/0057773 | A1 * | 3/2017 | Nakano | B65H 29/60 |
| 2017/0240374 | A1 * | 8/2017 | Moriya | G03G 15/6544 |

FOREIGN PATENT DOCUMENTS

| | | | |
|---|---|---|---|
| JP | 2012-140246 | A | 7/2012 |
| JP | 2015-182835 | A | 10/2015 |

OTHER PUBLICATIONS

Office Action dated May 29, 2018, in Japanese Patent Application No. 2016-031063.
Office Action dated Oct. 29, 2018, in Japanese Patent Application No. 2016-031063.

* cited by examiner

SHEET PROCESSING APPARATUS AND IMAGE FORMING SYSTEM

BACKGROUND OF THE INVENTION

Field of the Invention

The present invention relates to a sheet processing apparatus configured to perform predetermined processing on, for example, a sheet conveyed from an image forming apparatus, and to an image forming system including the sheet processing apparatus.

Description of the Related Art

Hitherto, there has been provided an image forming system in which a sheet processing apparatus is connected to an image forming apparatus such as a copying machine, a printer, a facsimile, and a multifunction peripheral of those. The sheet processing apparatus is configured to perform various types of post-processing such as sorting processing, aligning processing, offset processing, binding processing, folding processing, and perforating processing on sheets discharged from an image forming apparatus. The sheet processing apparatus is configured to place sheets from the image forming apparatus onto a processing tray, perform necessary post-processing, and then convey the sheets onto a stack tray.

In general, the sheet processing apparatus aligns a plurality of sheets to form a bundle of sheets and then performs post-processing, e.g., binding processing. At this time, when time for processing the bundle of sheets is longer than a conveyance time interval of sheets, there arises a disadvantage that a first sheet of a next bundle of sheets cannot be received during the processing on the preceding bundle of sheets. Therefore, there has been proposed a sheet conveyance device configured to adjust a conveyance speed of a sheet between an image forming apparatus and a sheet processing apparatus to increase an interval between bundles of sheets and obtain time for processing a bundle of sheets (see, for example, Japanese Patent Application Laid-Open No. 2009-120333).

Moreover, there has been known a sheet processing apparatus including a buffer portion, which is arranged on upstream of a sheet conveyance path and configured to convey a plurality of overlaid sheets, to feed the plurality of overlaid sheets as a bundle of sheets to downstream (see, for example, Japanese Patent Application Laid-Open No. 2004-277094). According to the sheet processing apparatus of Japanese Patent Application Laid-Open No. 2004-277094, the plurality of sheets overlaid in the buffer portion are fed with a predetermined time delay. With this, necessary time for processing to be performed on a preceding bundle of sheets is secured.

SUMMARY OF THE INVENTION

The present invention provides a sheet processing apparatus configured to perform predetermined processing with a processing portion. The provided sheet processing apparatus eliminates a fear in that, when a succeeding sheet conveyed on a sheet conveyance path passes a sheet placement portion, conveyance of the passing sheet is hindered by a processing portion located at the sheet placement portion and by an operation of the processing portion.

In order to achieve the above-mentioned object, according to one embodiment of the present invention, there is provided a sheet processing apparatus, including: a placement portion to which a sheet conveyed by a conveyance portion in a conveyance direction is placed; a processing portion configured to perform predetermined processing on a sheet placed on the placement portion, and to be movable in a predetermined moving range; and a control portion configured to control the processing portion to position, at a timing at which a sheet conveyed by the conveyance portion passes through the moving range, from a first position of preventing from interfering with the sheet to a second position of performing the predetermined processing on a preceding sheet having been conveyed by the conveyance portion and placed on the placement portion before the sheet.

With the sheet processing apparatus according to the present invention, conveyance of a succeeding passing sheet conveyed on the sheet conveyance path is prevented from being hindered by the processing portion processing a preceding sheet placed on the sheet placement portion.

Further features of the present invention will become apparent from the following description of exemplary embodiments with reference to the attached drawings.

DESCRIPTION OF THE EMBODIMENTS

Now, with reference to the attached drawings, embodiments of the present invention are described in detail. In the attached drawings, similar components are denoted by similar reference symbols in the entire specification.

Figure 1:
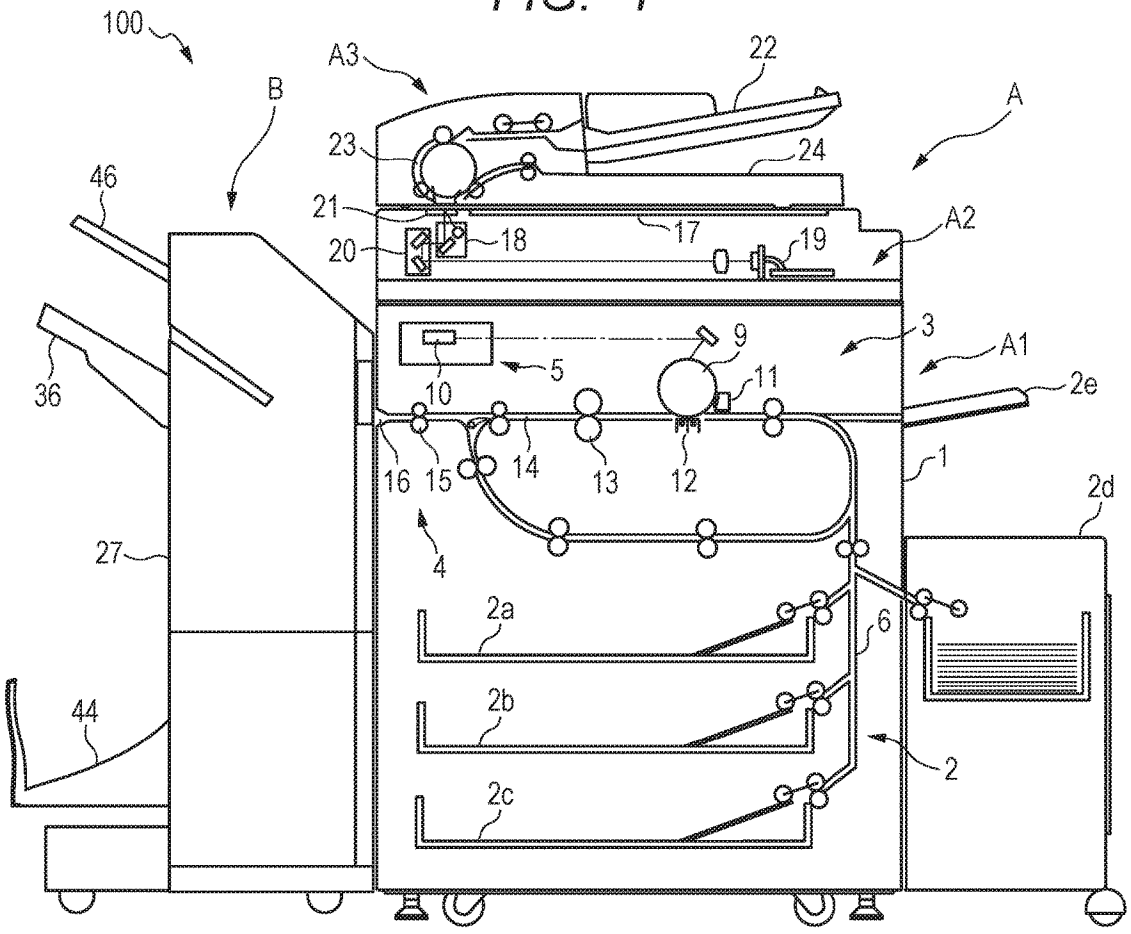
FIG. 1 is an explanatory view of the overall structure of an image forming system according to an embodiment of the present invention.

The overall structure of an image forming system including a sheet stacking apparatus according to the present embodiment is schematically illustrated in FIG. 1. As illustrated in FIG. 1, an image forming system 100 includes an image forming apparatus A and a sheet post-processing apparatus B juxtaposed to the image forming apparatus A. The image forming apparatus A includes an image forming unit A1, a scanner unit A2, and a feeder unit A3. In an apparatus housing 1, the image forming unit A1 includes a sheet feeding portion 2, an image forming portion 3, a sheet discharge portion 4, and a data processing portion 5.

The sheet feeding portion 2 includes a plurality of cassette mechanisms 2*a*, 2*b*, and 2*c* configured to store sheets of different sizes to be subjected to image formation, respectively, and sends out sheets having a size designated by a main body control portion (not shown) to a sheet feeding passage 6. The cassette mechanisms 2*a*, 2*b*, and 2*c* are removably placed in the sheet feeding portion 2, and each cassette mechanism includes a separating mechanism configured to separate sheets in the cassette mechanism into individual sheets and a sheet feeding mechanism configured to send out the sheets. On the sheet feeding passage 6, there are provided conveyance rollers configured to feed sheets, which are supplied from the respective cassette mechanisms 2*a*, 2*b*, and 2*c*, to downstream, and a registration roller pair arranged at an end portion of the passage and configured to align leading edges of the sheets.

A large capacity cassette 2*d* and a manual feed tray 2*e* are connected to the sheet feeding passage 6. The large capacity cassette 2*d* is an optional unit configured to store sheets having a size which is consumed in large amounts. The manual feed tray 2*e* is configured to enable supply of special sheets, such as thick sheets, coated sheets, and film sheets, which are difficult to be separated and fed.

The image forming portion 3 is, for example, an electrostatic printing mechanism, and includes a photosensitive drum 9 to be rotated, and a light emitting unit 10 configured to emit an optical beam, a developing unit 11, and a cleaner (not shown), which are arranged at the periphery of the photosensitive drum 9. The image forming portion 3 illustrated in FIG. 1 has a monochromatic printing mechanism. A latent image is optically formed on the photosensitive drum 9 by the light emitting unit 10, and the developing unit 11 causes toner ink to adhere on the latent image.

A sheet is fed from the sheet feeding passage 6 to the image forming portion 3 in synchronization with a timing of forming an image on the photosensitive drum 9, and the image is transferred onto the sheet by a transfer charger 12. The image is fixed on the sheet by fixing rollers 13 arranged on a sheet discharge passage 14. On the sheet discharge passage 14, there are arranged a sheet discharge roller 15 and a sheet discharge port 16 to convey the sheet having the image formed thereon to the sheet post-processing apparatus B.

The scanner unit A2 includes a platen 17 on which an image original is to be placed, a carriage 18 configured to reciprocate along the platen 17, a photoelectric conversion unit 19, and a reduction optical system 20 configured to guide light, which is radiated from the carriage 18 and reflected from the original placed on the platen 17, to the photoelectric conversion unit 19. The photoelectric conversion unit 19 is configured to photoelectrically convert optical output from the reduction optical system 20 to image data and to output the image data to the image forming portion 3 as an electric signal.

Further, the scanner unit A2 includes a running platen 21 configured to read a sheet fed from the feeder unit A3. The feeder unit A3 includes a sheet feeding tray 22, a sheet feeding passage 23 configured to guide the sheet fed from the sheet feeding tray 22 to the running platen 21, and a sheet discharge tray 24 configured to receive the original having passed on the running platen 21. The original fed from the sheet feeding tray 22 is read by the carriage 18 and the reduction optical system 20 when passing on the running platen 21.

In this embodiment, the image forming apparatus A is not limited to the image forming apparatus including the image forming portion 3 constructed by the electrostatic printing mechanism. For example, the image forming portion 3 including a shift printing mechanism, an ink jet printing mechanism, an ink ribbon transfer printing mechanism (such as thermal transfer ribbon printing and sublimation type ribbon printing), and other printing mechanisms may also be employed.

Figure 2:
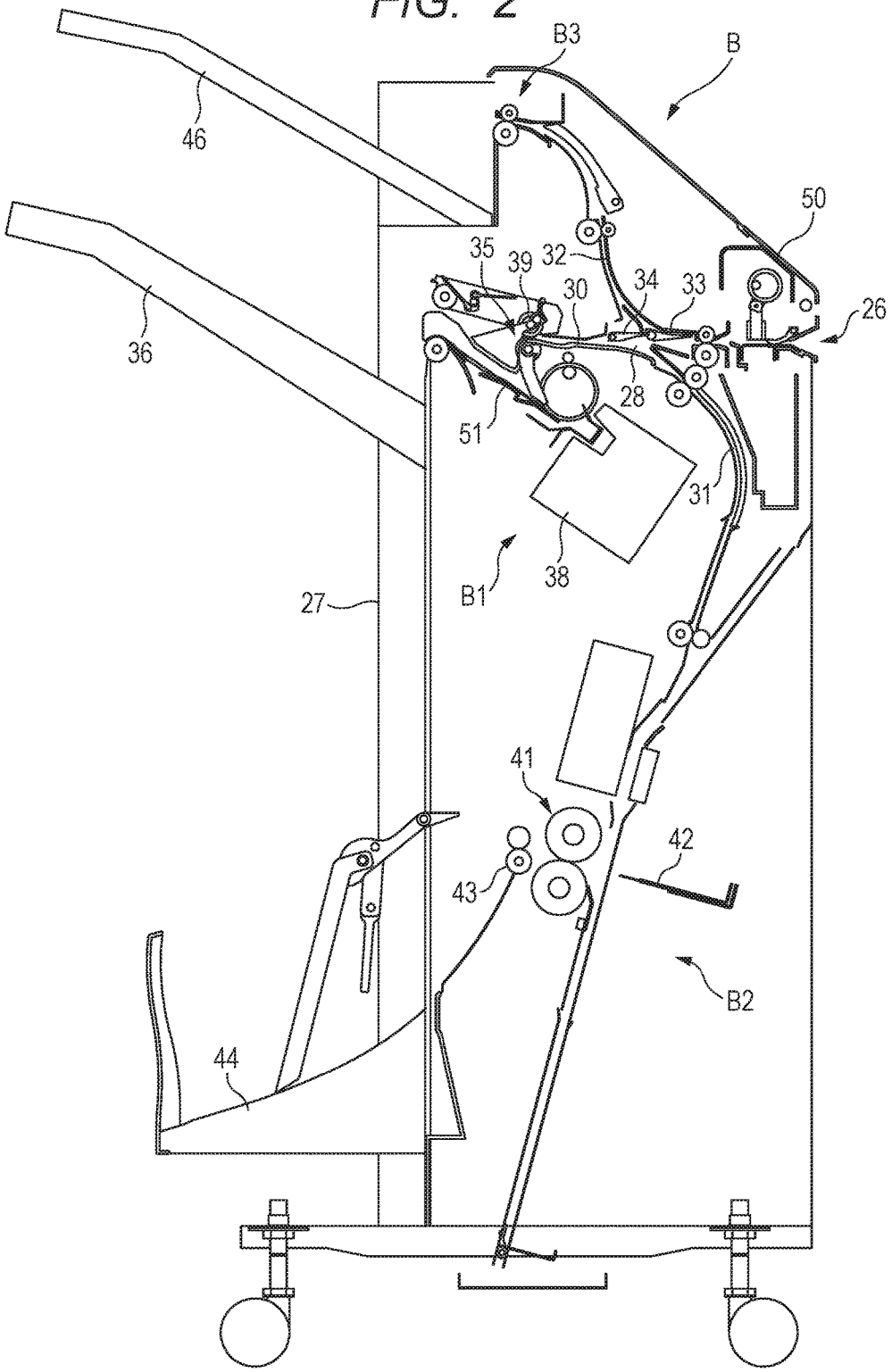
FIG. 2 is an explanatory view of the overall structure of a post-processing apparatus in the image forming system of FIG. 1.

FIG. 2 is an illustration of the sheet post-processing apparatus B configured to perform post-processing on a sheet on which an image is formed and which is fed from the image forming apparatus A. The sheet post-processing apparatus B includes an apparatus housing 27 having a carry-in port 26 for introducing the sheet from the image forming apparatus A. The apparatus housing 27 is arranged at a position corresponding to the apparatus housing 1 of the image forming apparatus A so that the carry-in port 26 communicates with the sheet discharge port 16 of the image forming apparatus A.

The sheet post-processing apparatus B includes a sheet carry-in passage 28 configured to convey a sheet introduced from the carry-in port 26, a first sheet discharge path 30, a second sheet discharge path 31, and a third sheet discharge path 32, which branch out from the sheet carry-in passage 28, a first path-switching unit 33, and a second path-switching unit 34. Each of the first path-switching unit 33 and the second path-switching unit 34 is a flapper guide configured to change a direction of conveyance of a sheet conveyed in the sheet carry-in passage 28.

The first path-switching unit 33 is configured to be switched by a driving unit (not shown) into a mode of guiding a sheet from the carry-in port 26 to the third sheet discharge path 32 and a mode of guiding the sheet to a direction toward the first sheet discharge path 30 or the second sheet discharge path 31. The first sheet discharge path 30 and the second sheet discharge path 31 are arranged to communicate with each other so as to enable switch-back conveyance of reversing the conveyance direction of a sheet, which has once been introduced to the first sheet discharge path 30, and conveying to the second sheet discharge path 31.

The second path-switching unit 34 is arranged on downstream of the first path-switching unit 33. The second path-switching unit 34 is similarly configured to be switched by a driving unit (not shown) into a mode of introducing a sheet which has passed under the first path-switching unit 33 to the first sheet discharge path 30 and a switch-back conveyance mode of causing a sheet, which has once been introduced to the first sheet discharge path 30, to be reversed and reversely conveyed to the second sheet discharge path 31.

The sheet post-processing apparatus B includes a first processing portion B1, a second processing portion B2, and a third processing portion B3, which perform different post-processing, respectively. Further, a punching unit 50 configured to form a punch hole in a introduced sheet is arranged on the sheet carry-in passage 28.

The first processing portion B1 is a binding processing portion configured to stack, align, and bind a plurality of sheets conveyed from a sheet discharge port 35 at a downstream end of the first sheet discharge path 30, and to discharge the sheets onto a stack tray 36 arranged outside the apparatus housing 27. The first processing portion B1 includes a sheet processing apparatus 37 according to the present embodiment, which is configured to convey a sheet or a bundle of sheets, and a binding processing unit 38 configured to bind a bundle of sheets. A discharge roller pair 39 configured to discharge sheets through the sheet discharge port 35 is arranged at the downstream end of the first sheet discharge path 30.

The second processing portion B2 is configured to bundle a plurality of sheets conveyed through the switch-back conveyance from the second sheet discharge path 31 to form a bundle of sheets, bind the bundle of sheets at a central portion, and then fold the bundle of sheets. In folding processing, the bundle of sheets is arranged so that its folding position is located at a nip portion of a pair of folding rolls 41 brought into pressure contact with each other. Then, a folding blade 42 is inserted from a side opposite to the pair of folding rolls 41, and the pair of folding rolls 41 is rotated to fold the bundle of sheets. The folded bundle of sheets is discharged by discharge rollers 43 to a stack tray 44 arranged outside the apparatus housing 27.

The third processing portion B3 is configured to perform jog-sorting to sort sheets conveyed from the third sheet discharge path 32 into a group in which sheets are stacked with a predetermined amount of offset in a direction intersecting the conveyance direction, and a group in which sheets are stacked without offset. The sheets subjected to the jog-sorting are discharged to a stack tray 46 arranged outside the apparatus housing 27, and offset bundles of sheets and bundles of sheets having no offset are stacked on top of each other.

Figure 3:
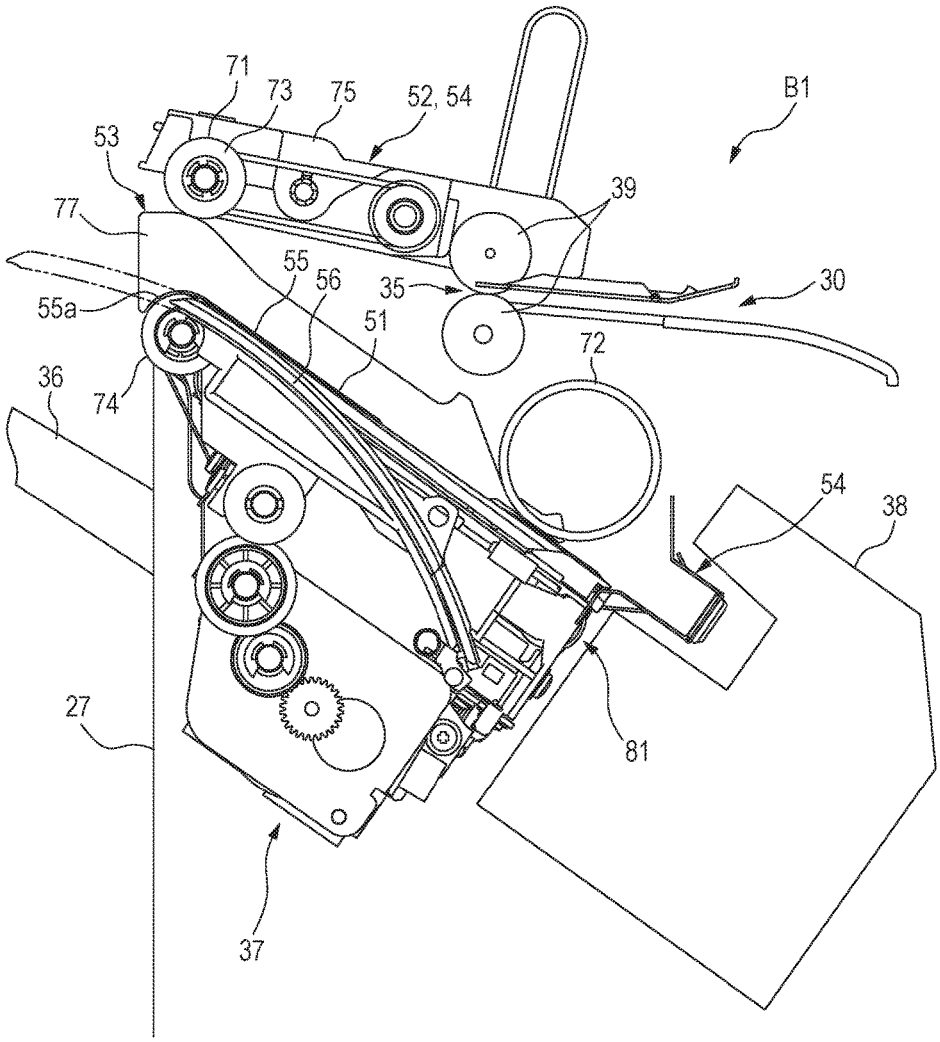
FIG. 3 is a side sectional view of the vicinity of a sheet processing apparatus of the post-processing apparatus of FIG. 2.

The overall structure of the first processing portion B1 of this embodiment is schematically illustrated in FIG. 3. The first processing portion B1 includes the sheet processing apparatus 37 configured to stack and align sheets from the sheet discharge port 35, and then discharge the bound sheets onto the stack tray 36, and the binding processing unit 38 configured to bind the bundle of sheets stacked and aligned by the sheet processing apparatus 37. The illustrated binding processing unit 38 is a stapler apparatus configured to drive a staple into the bundle of sheets to bind the bundle of sheets. A stapleless binding apparatus configured to perform binding processing on a bundle of sheets without a staple may also be used as the binding processing unit 38 instead of the stapler apparatus.

The sheet processing apparatus 37 includes a processing tray 51 (placement portion) arranged on downstream of the sheet discharge port 35 and spaced downwardly by a predetermined distance from the sheet discharge port 35. The sheet processing apparatus 37 includes a sheet carry-in mechanism 52, a sheet alignment mechanism 53, and a sheet carry-out mechanism 54. The sheet carry-in mechanism 52 is configured to convey a sheet to be subjected to binding processing, which is discharged from the sheet discharge port 35 to the processing tray 51, to a back side of the processing tray 51, that is, to an opposite side to a direction of carry-out to the stack tray 36. The sheet alignment mechanism 53 is configured to stack a plurality of sheets on the processing tray 51 in a bundle form and align the sheets. The sheet carry-out mechanism 54 is configured to convey the sheets having been subjected to binding processing to the stack tray 36.

Figure 4:
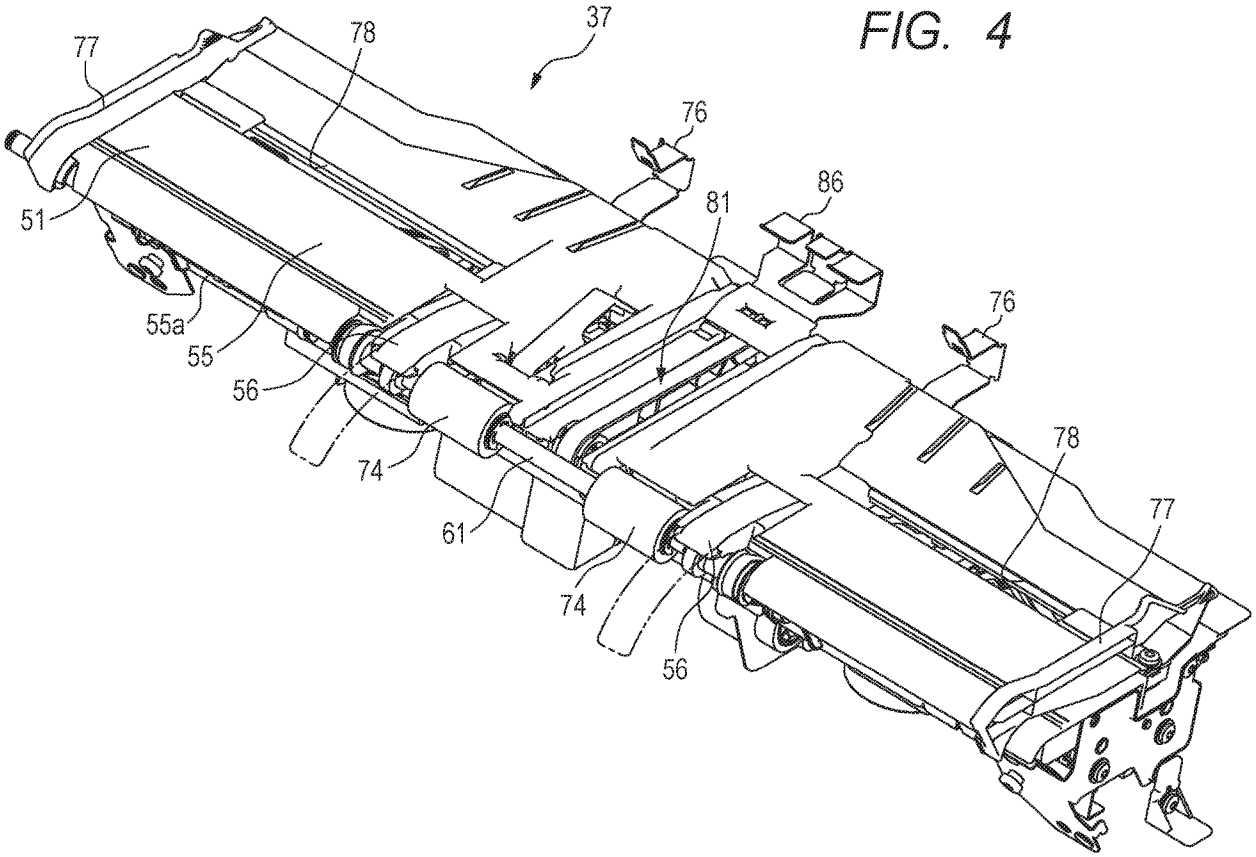
FIG. 4 is an overall perspective view of the sheet processing apparatus according to the embodiment.

As illustrated in FIG. 4, the processing tray 51 has, on its upper surface, a substantially flat sheet support surface 55 configured to at least partially support a sheet along a carry-out direction of the sheet. The sheet support surface 55 is inclined downward with a relatively large angle of about 40° from downstream toward upstream in the carry-out direction. The processing tray includes a pair of right and left auxiliary support members 56 which are protrudable and retractable with respect to the downstream of a downstream edge 55*a* of the sheet support surface 55 and toward a position above the stack tray 36.

The sheet carry-in mechanism 52 includes a conveyance roller apparatus 71 also serving as a sheet bundle carry-out mechanism 54, and a raking rotary member 72. The conveyance roller apparatus 71 includes two roller pairs arranged on right and left in the width direction. Each roller pair has an upper conveyance roller 73 and a lower conveyance roller 74 with respect to the processing tray 51 located therebetween. The upper conveyance roller 73 is rotatably supported at a distal end of a vertically movable bracket 75 swingably supported above the processing tray 51, and the lower conveyance roller 74 is rotatably mounted on a support rod 61 on the lower side of the processing tray 51.

When the sheet is discharged from the sheet discharge port 35 to the processing tray 51, the vertically movable bracket 75 is turned downward to bring the upper conveyance roller 73 into contact with an upper surface of the sheet on the processing tray 51. Next, the upper conveyance roller 73 is driven to rotate in a counterclockwise direction in FIG. 3, and the lower conveyance roller 74 is driven to rotate in a clockwise direction in FIG. 3. This allows the sheet to be conveyed on the processing tray 51 in a carry-in direction, that is, in a direction opposite to the carry-out direction.

The raking rotary member 72 is a ring-shaped or short cylindrical belt member rotatably arranged above the processing tray 51 on upstream in the carry-out direction. The belt member rotates in the counterclockwise direction in FIG. 3 while being in contact with and pressing the upper surface of the sheet being conveyed on the processing tray 51. This allows the sheet to be fed until its leading edge comes into contact with the sheet edge regulating members 76 provided at an upstream end of the processing tray 51 in the carry-out direction while protecting the sheet being conveyed from curling and skewing that may occur. Each sheet edge regulating member 76 is, for example, a channel-like member having a substantially U-shaped section as illustrated in FIG. 4.

The sheet alignment mechanism 53 includes a sheet edge regulating portion and a side alignment mechanism. The sheet edge regulating portion has the pair of sheet edge regulating members 76 arranged on right and left. The sheet edge regulating members 76 regulate and/or align, in the carry-in (or carry-out) direction, the position of the sheet having been conveyed from the sheet discharge port 35 to the processing tray 51 at the leading edge of the sheet in the carry-in direction (or at the trailing edge of the sheet in the carry-out direction).

The side alignment mechanism moves a sheet or a bundle of sheets on the processing tray 51 in the width direction to restrict and/or align the positions in the width direction at side edges of the sheet and the bundle of sheets. As illustrated in FIG. 4, the side alignment mechanism includes a pair of side alignment members 77 arranged on right and left with respect to a center of the processing tray 51 in its width direction. The side alignment members 77 are each a flat platelike member protruding vertically upward from the sheet support surface 55 of the processing tray 51, with their inner surfaces facing each other. The inner surface of each side alignment member 77 is engaged with the adjacent side edge in the width direction of the sheet on the processing tray to restrict the position of the sheet in its width direction.

Each side alignment member 77 is integrally connected to a movable support portion (not shown) provided on a back side of the processing tray 51 through a linear slit 78 in the width direction, which is formed through the processing tray 51. Each of the movable support portions is driven by an individual drive motor through intermediation of, for example, a rack-and-pinion mechanism to reciprocate in the width direction. Accordingly, the respective side alignment members 77 can be moved independently of each other in directions of becoming closer to or away from each other to be stopped at desired positions in the width direction.

Figure 5:
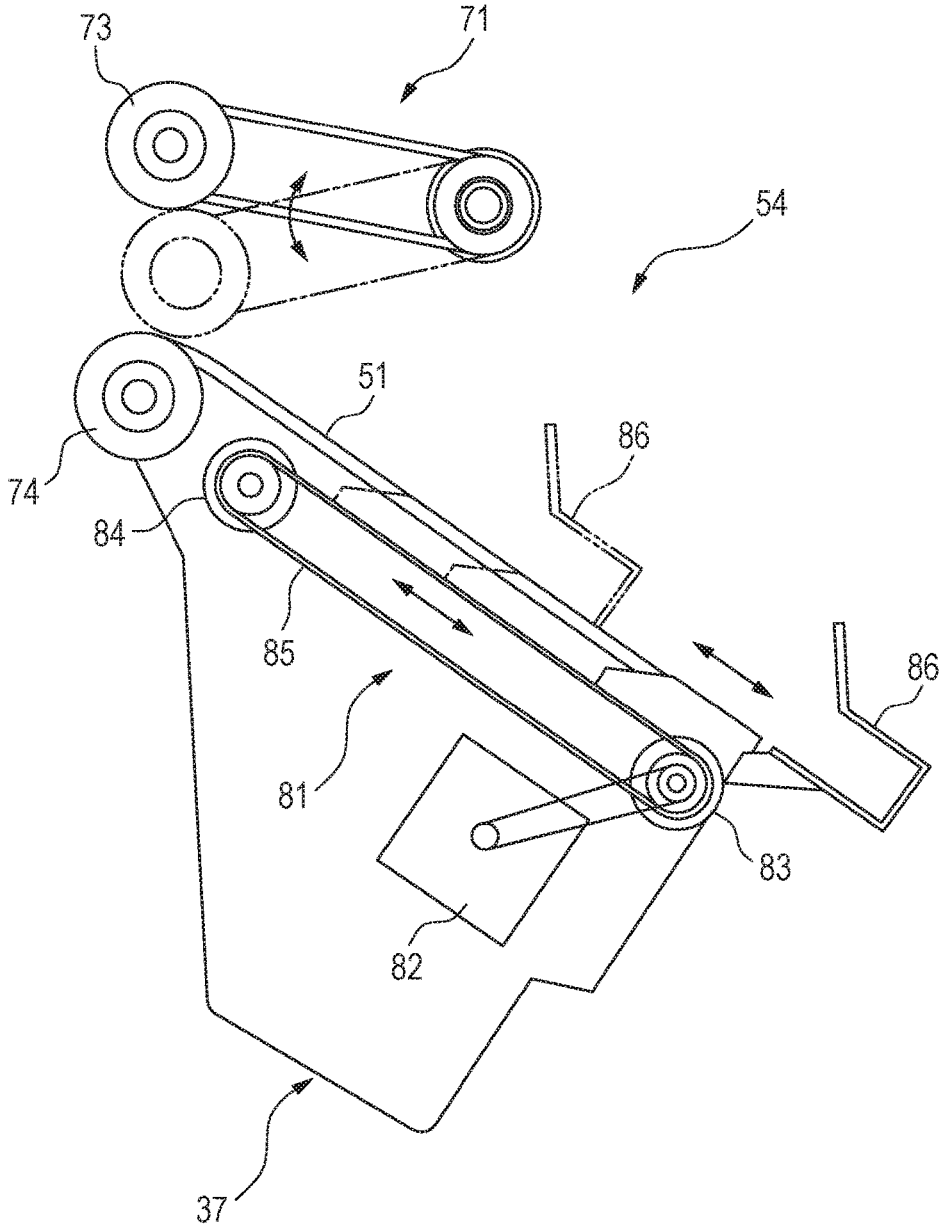
FIG. 5 is a schematic structural view of a sheet conveyance mechanism.

As illustrated in FIG. 5, the sheet carry-out mechanism 54 includes a conveyor device 81 and the conveyance roller apparatus 71. The conveyor device 81 includes a conveyor belt 85 stretched around a drive pulley 83 driven by a drive motor 82 and a driven pulley 84, and circumferentially moving in both directions along the carry-out direction of the sheet. A sheet push-out member moving along the sheet support surface 55 of the processing tray 51 is fixed to the conveyor belt 85.

The sheet push-out member 86 is arranged to be movable in both directions between an initial position near the upstream end of the processing tray 51 in the carry-out direction and a maximum push-out position set substantially midway between the drive pulley 83 and the driven pulley 84. The sheet push-out member 86 is, for example, a channel-like member having a U-shaped cross-section illustrated in FIG. 4, and is configured to feed out the sheet in the carry-out direction so that the trailing edge of the sheet, i.e. the upstream edge of the sheet in the carry-out direction, on the sheet support surface 55 is pushed out. Further, the sheet push-out member 86 serves as a part of the sheet edge restricting portion to restrict a trailing edge position of the sheet at least at a position to which the sheet push-out member 86 is moved in the carry-out direction from the initial position.

The conveyance roller apparatus 71 is arranged so that the upper conveyance roller 73 and the lower conveyance roller 74 in each pair nip the sheet from above and below in a conveyable manner at the vicinity of a downstream end of the processing tray 51 in the carry-out direction. As illustrated in FIG. 4, the roller pairs on right and left are arranged so as to be symmetric with respect to the center of the processing tray 51 in the width direction.

Figure 6:
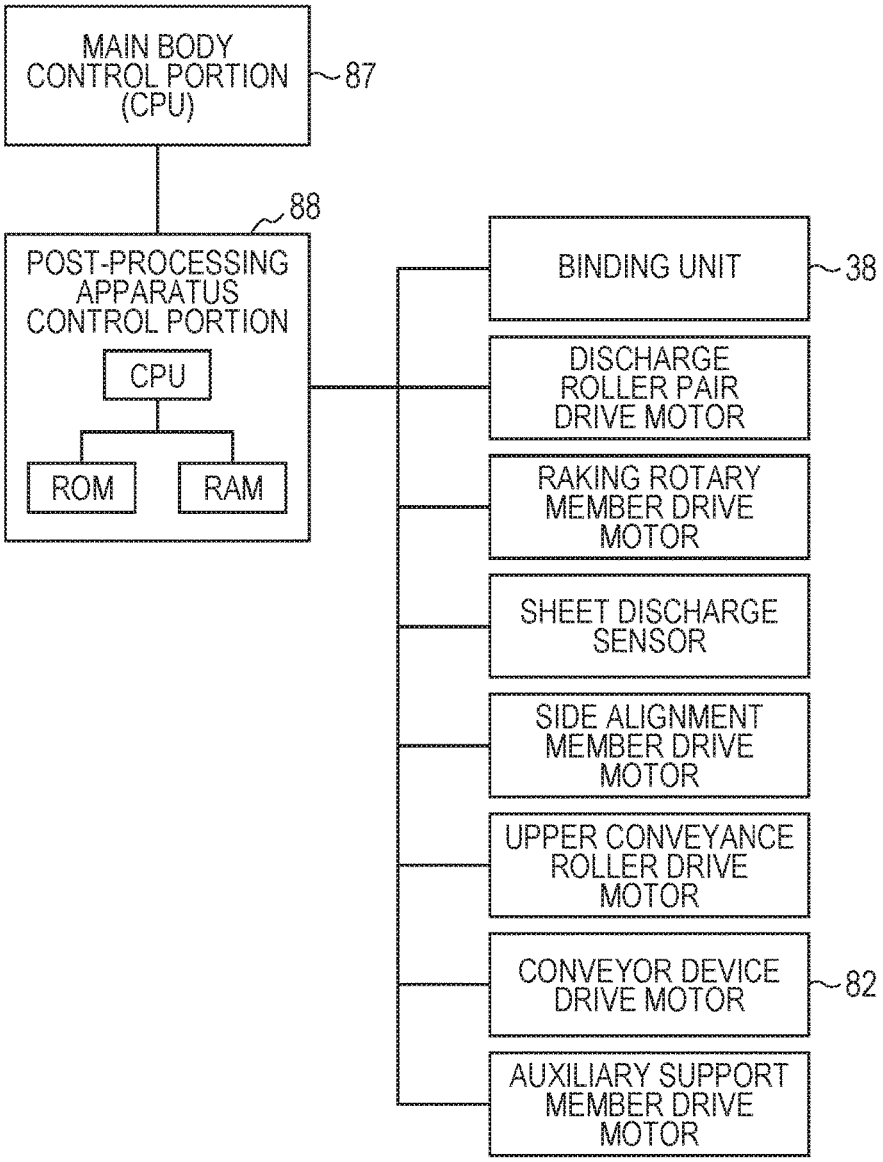
FIG. 6 is an explanatory diagram of the control structure in the sheet processing apparatus.

FIG. 6 is a view for illustrating the control structure of the image forming system 100 including the sheet processing apparatus 37 according to the embodiment. The image forming system 100 includes a main body control portion 87 of the image forming apparatus A and a post-processing apparatus control portion 88 of the sheet post-processing apparatus B, which is connected to the main body control portion 87. Through an input portion (not shown) connected to the main body control portion 87, a user performs setting of an image forming mode in the image forming apparatus A and a post-processing mode in the sheet post-processing apparatus B.

In the image forming mode, modes such as color or monochromatic printing, duplex printing, and simplex printing, and image forming conditions such as a sheet size, a sheet quality, the number of printouts, enlarged printing, and reduced printing are set. In the post-processing mode, conditions of various post-processing modes such as an aligning processing mode, a binding processing mode, a folding processing mode, and a perforating processing mode are set.

The main body control portion 87 transfers information related to the set conditions of the post-processing mode, the number of sheets, the number of sets, a sheet size, and the like to the post-processing apparatus control portion 88. Further, at each time image formation on a sheet is terminated, the main body control portion 87 transmits a job termination signal to the post-processing apparatus control portion 88.

The post-processing apparatus control portion 88 includes a control CPU, and a ROM and a RAM connected to the control CPU, and executes predetermined post-processing in the first processing portion B1 based on a control program stored in the ROM and control data stored in the RAM. Therefore, all of the above-mentioned drive motors and sensors are connected to the CPU of the post-processing apparatus control portion 88 and the CPU controls drive of the respective drive motors.

Figure 7A:
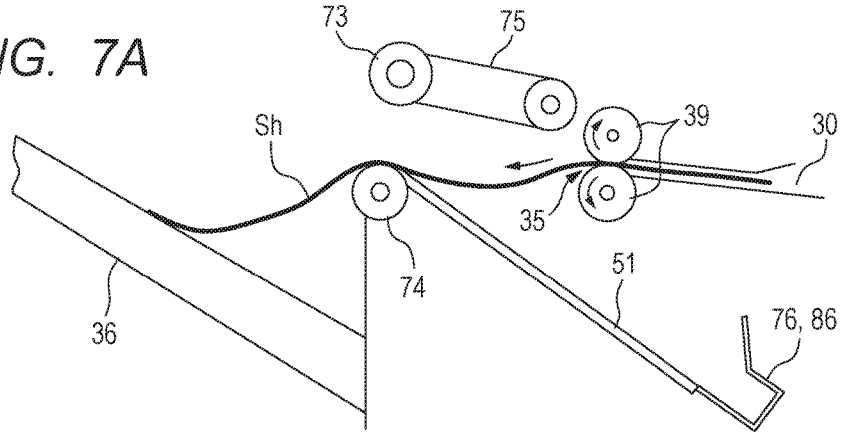
FIG. 7A is a schematic explanatory view for illustrating a process of conveying a sheet to a processing tray.
Figure 7B:
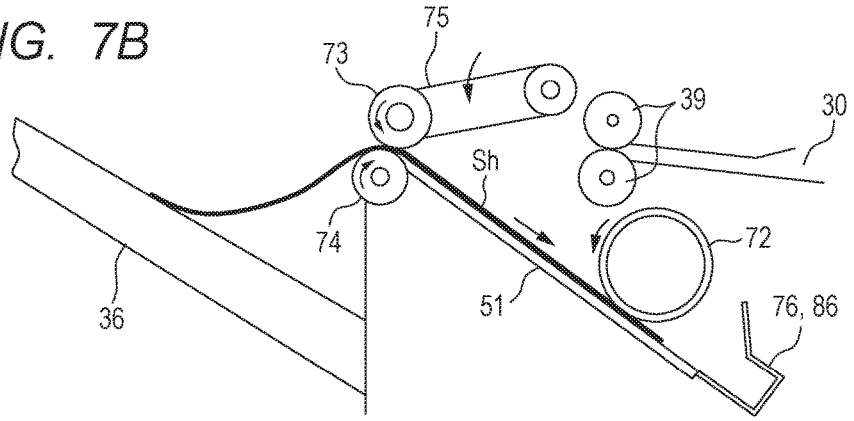
FIG. 7B is a schematic explanatory view for illustrating the process of conveying the sheet to the processing tray.
Figure 7C:
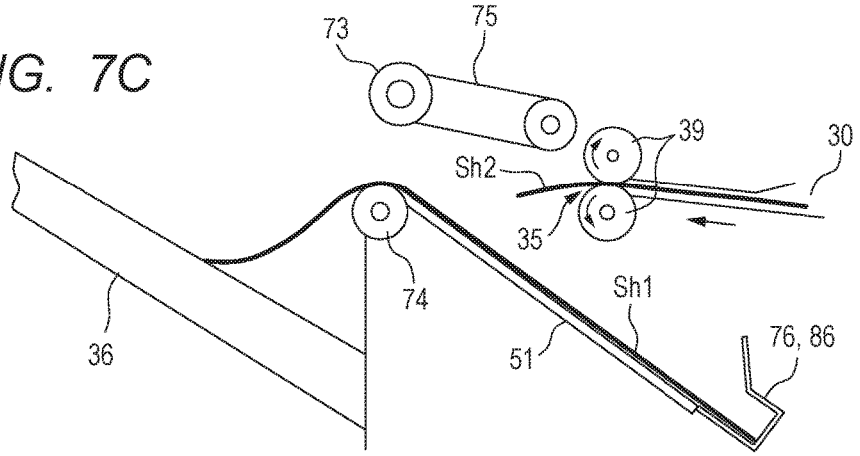
FIG. 7C is the schematic explanatory view for illustrating a process of conveying the sheet to the processing tray.
Figure 9E:
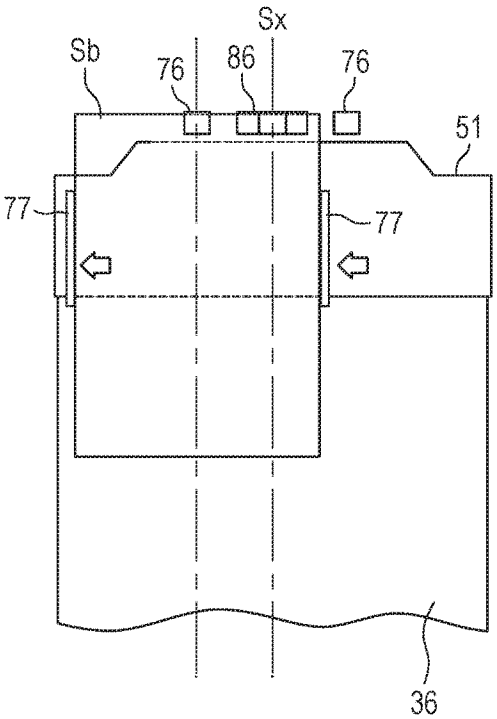
FIG. 9E is a schematic explanatory view for illustrating the process of conveying and stacking the succeeding sheet to the processing tray, which is subsequent to FIG. 8C.

A process of stacking a plurality of sheets Sh on the processing tray 51 to form a bundle of sheets and thereafter conveying the sheets to the stack tray 36 through control on the sheet processing apparatus 37 and the discharge roller pair 39 by the post-processing apparatus control portion 88 is described with reference to the attached drawings. FIG. 7A to FIG. 7C are views for illustrating a process of conveying the sheet Sh to the processing tray 51. FIG. 8A, FIG. 8B, FIG. 8C, FIG. 9D, and FIG. 9E are views for illustrating a process of stacking a succeeding sheet on the processing tray 51 to form a bundle of sheets. FIG. 10A to FIG. 10D are views for illustrating a process of conveying the bundle of sheets on the processing tray 51 to the stack tray 36. FIG. 11A and FIG. 11B are flowcharts for illustrating a process from stacking a plurality of sheets on the processing tray 51 to form a bundle of sheets to conveying the bundle of sheets to the stack tray 36.

First, as illustrated in FIG. 7A, the discharge roller pair 39 (conveyance portion) is rotated to discharge the sheets Sh from the sheet discharge port 35 to the processing tray 51 (Step St1). When sheet discharge sensors arranged in the vicinities of the first sheet discharge path 30 and the sheet discharge port 35 detect a trailing edge of the sheet Sh to detect discharge of the sheet Sh to the processing tray 51, the sheet carry-in mechanism 52 is operated (Step St2). As illustrated in FIG. 7B, the vertically movable bracket 75 is turned downward to bring the upper conveyance roller 73 into contact with the upper surface of the sheet on the processing tray 51, and the upper conveyance roller 73 is rotated in the counterclockwise direction in FIG. 7B. The raking rotary member 72 is also turned in the counterclockwise direction in FIG. 7B, to thereby convey the sheet Sh in the carry-in direction.

Figure 8A:
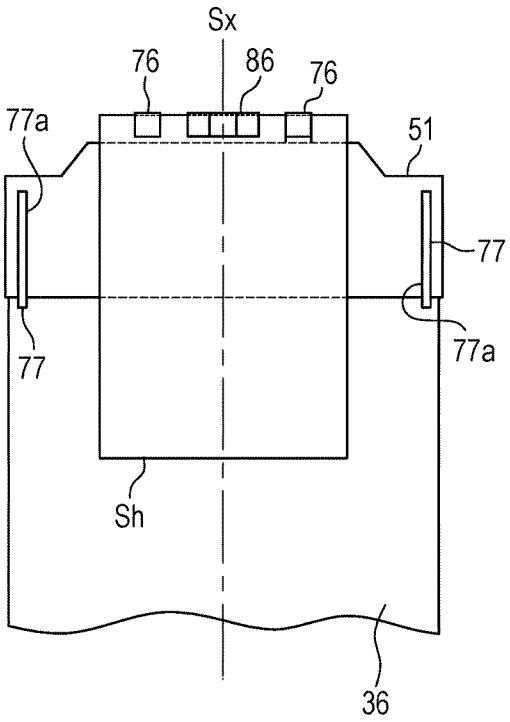
FIG. 8A is a schematic explanatory view for illustrating a process of conveying and stacking a succeeding sheet to the processing tray, which is subsequent to FIG. 7C.

As illustrated in FIG. 7C and FIG. 8A, after the sheet Sh1 is conveyed until the leading edge of the sheet Sh1 comes into contact with the sheet edge regulating members 76, the upper conveyance roller 73 and the raking rotary member 72 are stopped. With this, the trailing edge of the sheet Sh1 in the carry-out direction of the sheet Sh1 is positioned by the sheet edge regulating members 76. At this time, an edge of the sheet Sh1 on downstream in the carry-out direction of the sheet Sh1 is in contact with an upper surface of the stack tray 36 or with an upper surface of a sheet on the stack tray 36, and the sheet Sh1 is supported so as to extend over the processing tray 51 and the stack tray 36.

Figure 8B:
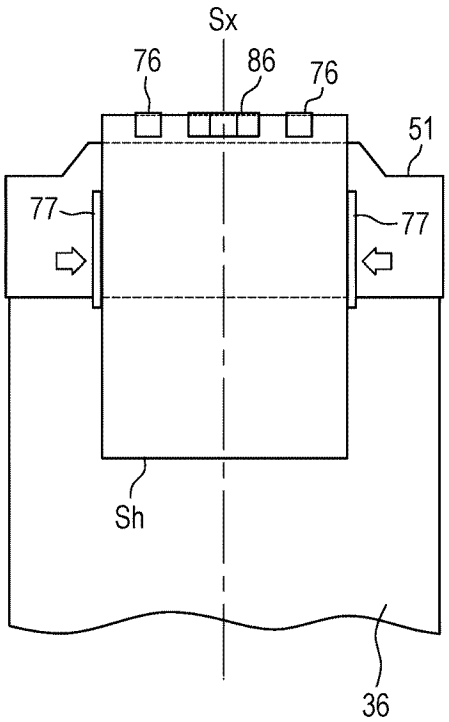
FIG. 8B is a schematic explanatory view for illustrating the process of conveying and stacking the succeeding sheet to the processing tray, which is subsequent to FIG. 7C.

Next, the right and left side alignment members 77 at retreated positions in FIG. 8A are moved inward so as to hold the sheet Sh from both sides (Step St3). The side alignment members 77 are engaged, at respective regulating surfaces 77*a* thereof, with both side edges of the sheet Sh, and moved to positions at which the distance of separation of the regulating surfaces matches with the width dimension of the sheet Sh. With this, as illustrated in FIG. 8B, a widthwise center of the sheet Sh is aligned with a stacking position matching with a center reference Sx of the processing tray 51. After that, the side alignment members 77 are respectively returned to the retreated positions of FIG. 8A.

Figure 8C:
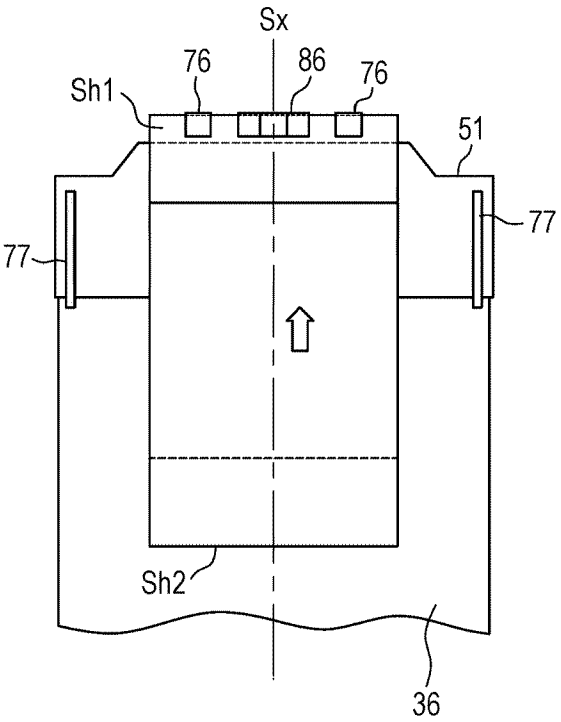
FIG. 8C is a schematic explanatory view for illustrating the process of conveying and stacking the succeeding sheet to the processing tray, which is subsequent to FIG. 7C.

As illustrated in FIG. 8C, the next sheet Sh2 is discharged onto the preceding sheet Sh1 on the processing tray 51 as in FIG. 7A (Step St4). The next sheet Sh2 is conveyed until the leading edge of the sheet Sh2, that is, the trailing edge of the sheet Sh2 in the carry-out direction comes into contact with the sheet edge regulating members 76 through rotation of the upper conveyance roller and the raking rotary member 72 as in FIG. 7B, and positioned thereat (Step St5). Next, as in FIG. 8A, the side alignment members 77 are moved inward to hold the sheet Sh2 from both sides with the regulating surfaces 77*a*, and a widthwise center of the sheet Sh2 is aligned with the center reference Sx of the processing tray 51 (Step St5). With this, as illustrated in FIG. 9D, the next sheet Sh2 is aligned with the preceding sheet Sh1 on the processing tray in the carry-out direction and in the widthwise direction, and stacked thereon.

Figure 9D:
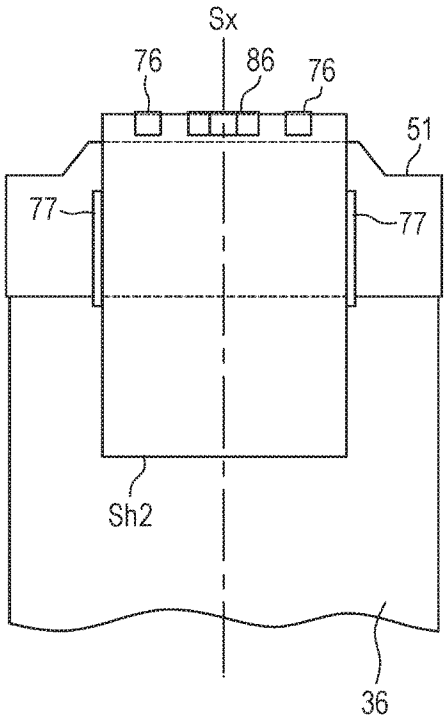
FIG. 9D is a schematic explanatory view for illustrating the process of conveying and stacking the succeeding sheet to the processing tray, which is subsequent to FIG. 8C.
Figure 10A:
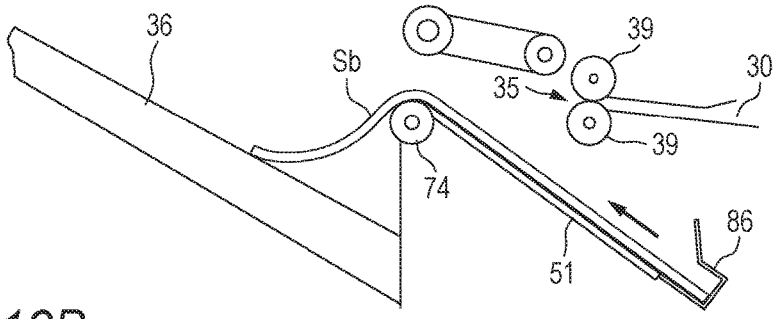
FIG. 10A is a schematic explanatory view for illustrating a process of conveying a bundle of sheets from the processing tray to a stack tray, which is subsequent to FIG. 9E.

The above-mentioned processes in FIG. 8C and FIG. 9D are repeated, to thereby form the bundle of sheets including a predetermined number of sheets on the processing tray 51 (Step St7). The formed bundle of sheets can be moved to offset by a predetermined distance in the width direction, that is, a direction perpendicular to the carry-out direction as needed. The offset movement is performed by moving the side alignment members 77 in the width direction as illustrated in FIG. 9E while holding the bundle of sheets Sb from both sides, without returning the side alignment members 77 to the retreated positions.

Next, the bundle of sheets Sb having been formed on the processing tray 51 and moved to offset as needed is conveyed to the stack tray 36 by the sheet carry-out mechanism 54. While the bundle of sheets Sb is held by the side alignment members 77 from both sides as illustrated in FIG. 9E, the conveyor device 81 is operated. Then, the sheet push-out member 86 is driven to move from the upstream end position in the carry-out direction of FIG. 10A to the maximum push-out position of FIG. 10B, to thereby convey the bundle of sheets Sb in the carry-out direction to the position at which the trailing edge of the bundle of sheets Sb in the carry-out direction reaches the maximum push-out position (Step St8).

Figure 10B:
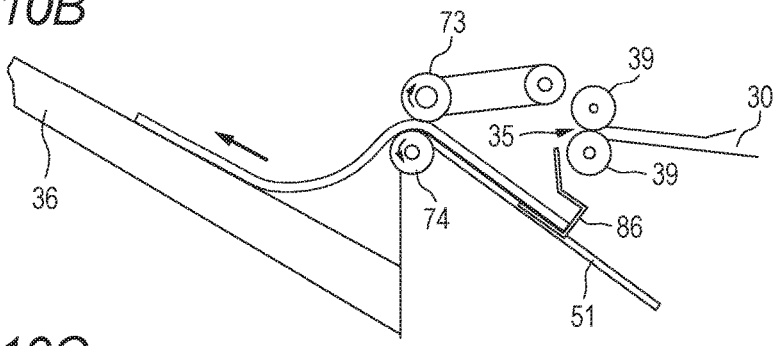
FIG. 10B is a schematic explanatory view for illustrating the process of conveying the bundle of sheets from the processing tray to the stack tray, which is subsequent to FIG. 9E.
Figure 10C:
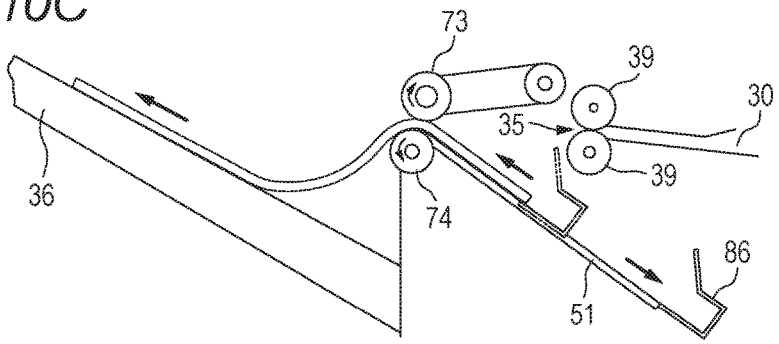
FIG. 10C is a schematic explanatory view for illustrating the process of conveying the bundle of sheets from the processing tray to the stack tray, which is subsequent to FIG. 9E.
Figure 10D:
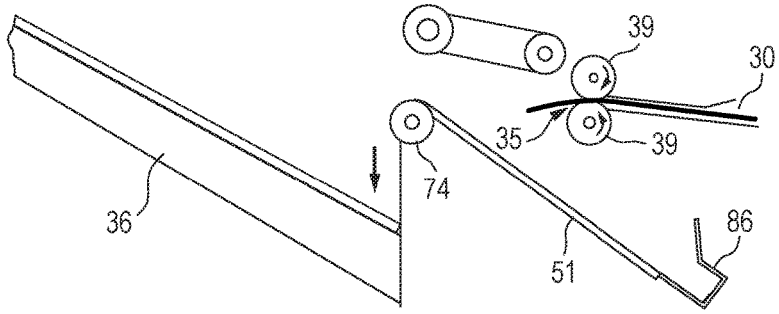
FIG. 10D is a schematic explanatory view for illustrating the process of conveying the bundle of sheets from the processing tray to the stack tray, which is subsequent to FIG. 9E.
Figure 11A:
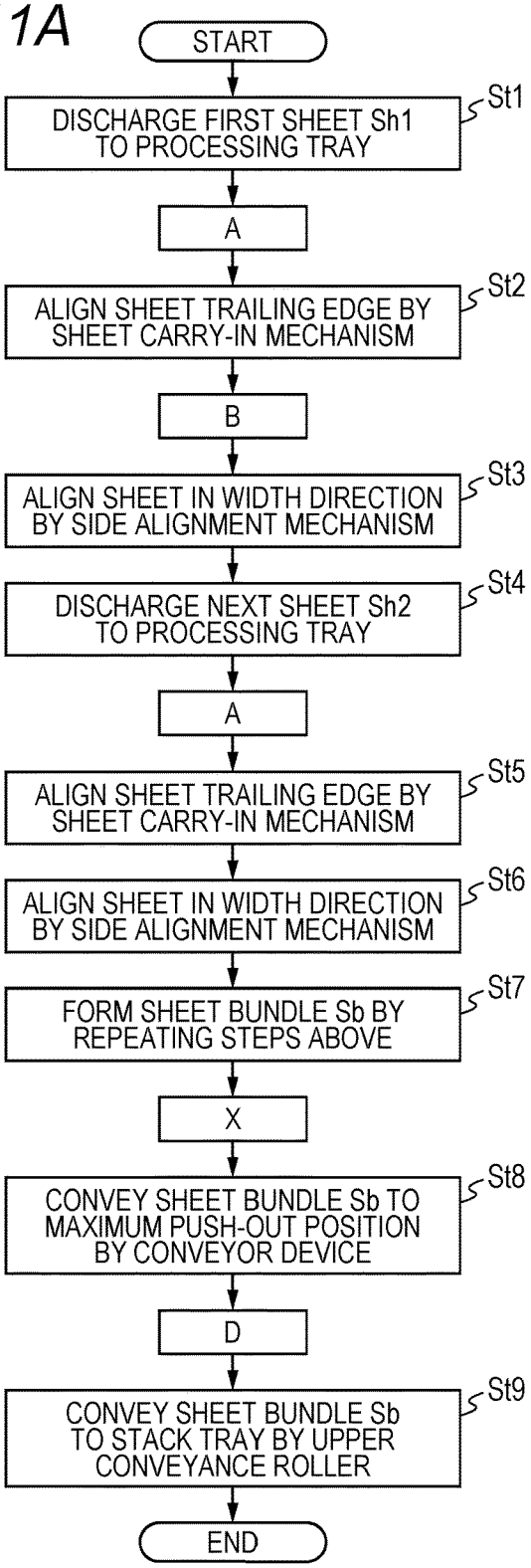
FIG. 11A is a flowchart for illustrating a process from stacking sheets on the processing tray to conveying the sheets to the stack tray.
Figure 11B:
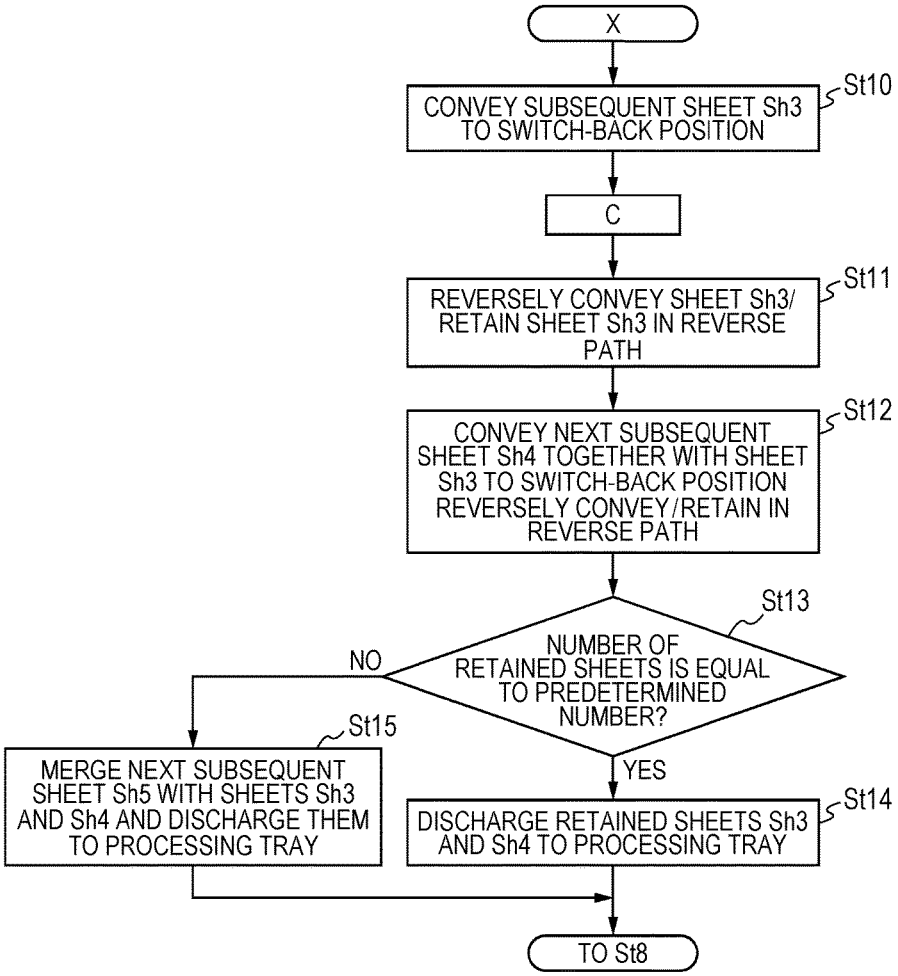
FIG. 11B is a flowchart for illustrating the process from stacking the sheets on the processing tray to conveying the sheets to the stack tray.

After the sheet push-out member 86 is stopped at the maximum push-out position, as illustrated in FIG. 10B, the upper conveyance roller 73 is moved downward to come into contact with the upper surface of the bundle of sheets Sb, to thereby sandwich the bundle of sheets Sb with the lower conveyance roller 74. As illustrated in FIG. 10C, the upper conveyance roller 73 is driven to rotate in the clockwise direction in FIG. 10C, and the lower conveyance roller 74 is driven to rotate in the counterclockwise direction in FIG. 10C, to thereby convey the bundle of sheets Sb in the carry-out direction. The sheet push-out member 86 is returned to the upstream end position in the carry-out direction after being stopped at the maximum push-out position. As illustrated in FIG. 10D, the bundle of sheets Sb is conveyed onto the stack tray 36 by the upper conveyance roller 73 and the lower conveyance roller (Step St9).

The sheet post-processing apparatus B has a buffering function of temporarily retaining a succeeding sheet on upstream of the first sheet discharge path 30. In this embodiment, during predetermined processing on a preceding bundle of sheets Sb placed on the processing tray 51, a succeeding sheet Sh3 delivered from the image forming apparatus A is conveyed from the sheet carry-in passage 28 to the first sheet discharge path 30 under a state in which the first and second path-switching units 33 and 34 are opened. Then, the sheet Sh3 is buffered, that is, temporarily retained in a reverse path 90 (guide portion) without being discharged from the sheet discharge port 35 to the processing tray 51. With this, a sheet discharged from the image forming apparatus A can be received in the sheet post-processing apparatus B without interruption or delay, thereby being capable of maintaining high productivity.

In this embodiment, the predetermined processing to be performed on the preceding bundle of sheets Sb on the processing tray 51 is aligning processing of aligning positions of a plurality of placed sheets to form a bundle of sheets through use of the sheet edge regulating portion and the side alignment mechanism of the sheet alignment mechanism 53. The reverse path 90 is an upstream portion of the second sheet discharge path 31 communicating with upstream of the first sheet discharge path 30.

Figure 12A:
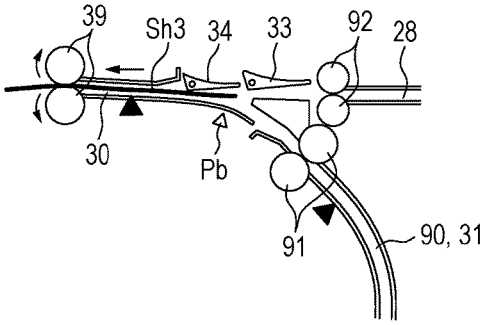
FIG. 12A is a schematic explanatory view for illustrating a process of buffering a succeeding sheet.

FIG. 12A to FIG. 12E are views for illustrating a process of buffering a succeeding sheet. As illustrated in FIG. 12A, a succeeding sheet Sh3 is conveyed in the first sheet discharge path 30 to downstream by the discharge roller pair 39 until a trailing edge, that is, an upstream edge of the sheet Sh3 passes the second path-switching unit 34 to reach a predetermined switch-back position Pb (Step St10). At this time, a downstream leading edge portion of the sheet Sh3 extends above the processing tray 51 from the sheet discharge port 35, but is not completely discharged.

Figure 12B:
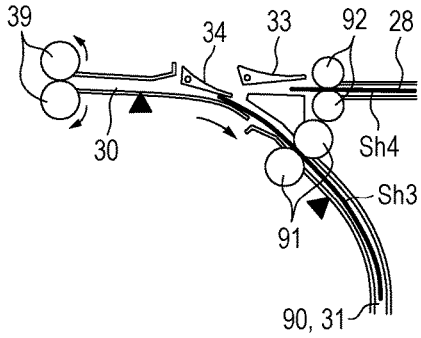
FIG. 12B is a schematic explanatory view for illustrating the process of buffering the succeeding sheet.

When the trailing edge of the succeeding sheet Sh3 reaches the switch-back position Pb, as illustrated in FIG. 12B, the second path-switching unit 34 is closed, and the discharge roller pair 39 is reversely rotated, to thereby perform switch-back conveyance of the succeeding sheet Sh3 to deliver the sheet Sh3 into the reverse path 90 (second sheet discharge path 31) (Step St11). The sheet Sh3 is held at a predetermined buffer position in the reverse path 90 under a state in which a downstream edge of the sheet Sh3 is positioned near an inlet of the first sheet discharge path 30 and sandwiched by the conveyance roller pair 91.

Figure 12C:
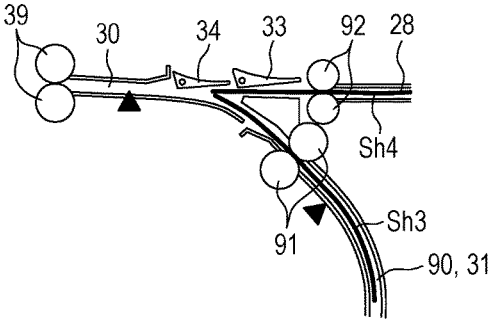
FIG. 12C is a schematic explanatory view for illustrating the process of buffering the succeeding sheet.

A next succeeding sheet Sh4 is conveyed in the sheet carry-in passage 28, and a downstream leading edge of the sheet Sh4 enters the first sheet discharge path 30. As illustrated in FIG. 12C, when the downstream leading edge of the sheet Sh4 reaches a position matching with the downstream edge of the previous succeeding sheet Sh3 positioned at the buffer position, the conveyance roller pair 91 is rotated to convey the previous succeeding sheet Sh3 from the reverse path 90 to the first sheet discharge path 30. The conveyance speed of the conveyance roller pair 91 is equal to the conveyance speed of the conveyance roller pair 92 on the sheet carry-in passage 28. The previous succeeding sheet Sh3 and the next succeeding sheet Sh4 are conveyed toward the discharge roller pair 39 under a state of being overlaid in the first sheet discharge path 30 (Step St12).

Figure 12D:
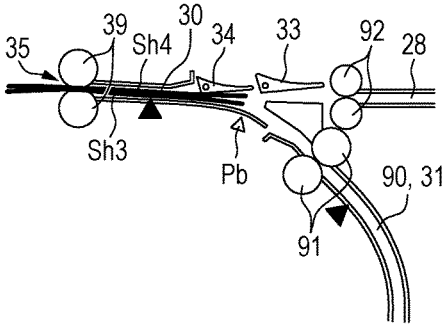
FIG. 12D is a schematic explanatory view for illustrating the process of buffering the succeeding sheet.

The discharge roller pair 39 conveys the succeeding sheets Sh3 and Sh4 in the carry-out direction to partially discharge the sheets Sh3 and Sh4 from the sheet discharge port 35. As illustrated in FIG. 12D, trailing edge positions of the succeeding sheets Sh3 and Sh4 reach the switch-back position Pb in the first sheet discharge path 30. Then, the second path-switching unit 34 is closed, and the discharge roller pair 39 is reversely rotated, to thereby perform the switch-back conveyance of the succeeding sheets Sh3 and Sh4 to deliver the succeeding sheets Sh3 and Sh4 into the reverse path 90. The succeeding sheets Sh3 and Sh4 conveyed to the reverse path are sandwiched by the conveyance roller pair 91, conveyed to the predetermined buffer position, and held thereat.

Figure 12E:
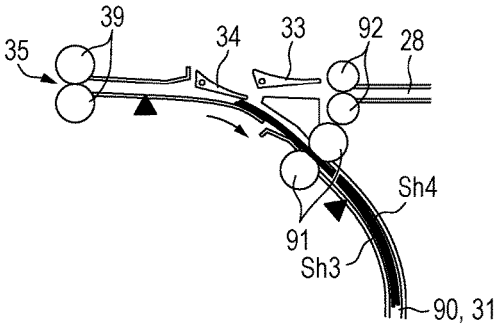
FIG. 12E is a schematic explanatory view for illustrating the process of buffering the succeeding sheet.

The series of processes are repeated so that, as illustrated in FIG. 12E, a predetermined number of succeeding sheets Sh3 and Sh4 can be retained in the reverse path 90. The number of sheets to be retained can be set in accordance with time required for aligning processing on the bundle of sheets Sb in the first processing portion B1 and the conveyance speed of the sheets to be delivered from the image forming apparatus A. The number of sheets to be retained does not exceed the number of sheets in the bundle of sheets to be subjected to the aligning processing at one time.

The succeeding sheets Sh3 and Sh4 in the reverse path 90 are conveyed again by the conveyance roller pair 91 to the first sheet discharge path 30 at a timing at which the aligning processing on the bundle of sheets Sb in the first processing portion B1 is terminated. The path extending from the reverse path 90 to pass through the first sheet discharge path 30 is curved with a curvature smaller than that of at least the sheet carry-in passage 28. Thus, there is a fear in that, when the sheets Sh3 and Sh4 are conveyed from the reverse path 90 at high speed, there may occur damages such as bend, curve, wrinkle, and tear. In order to prevent the above-mentioned damages, the sheet conveyance speed in the reverse path 90 by the conveyance roller pair 91 is set to be lower than the sheet conveyance speed in the sheet carry-in passage 28 by the conveyance roller pair 92.

The number of the buffered sheets Sh3 and Sh4 is counted, and it is determined whether or not the counted number is equal to the number of sheets in the bundle of sheets to be subjected to the aligning processing at one time (Step St13). When the numbers are equal, the sheets Sh3 and Sh4 are conveyed from the reverse path 90 to the processing tray 51 before another succeeding sheet is delivered from the image forming apparatus A to the first sheet discharge path 30 (Step St14). With this, the succeeding sheet may be prevented from catching up and hitting on the trailing edges of the buffered sheets Sh3 and Sh4 in the first sheet discharge path 30. Further, occurrence of problems caused by the hitting, such as hindrance of the conveyance to the processing tray 51, damage on sheets, and jam (sheet jam) by merging of the succeeding sheet, may be prevented.

Figure 13A:
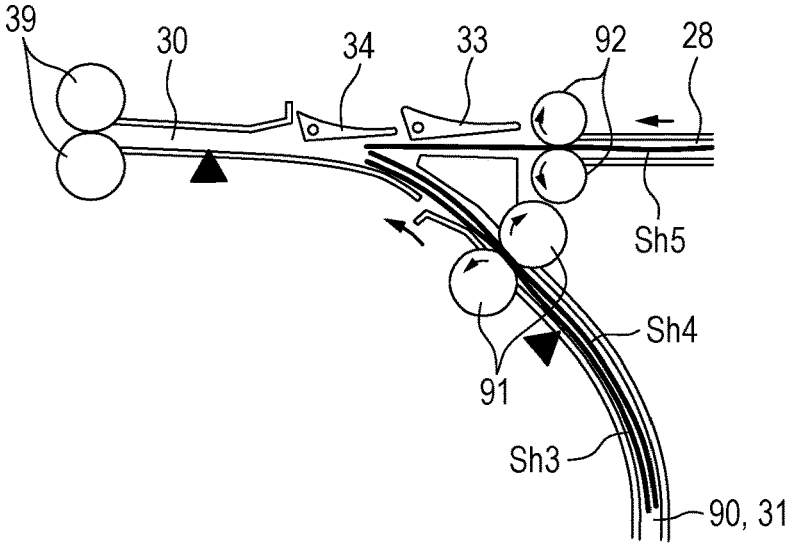
FIG. 13A is a schematic explanatory view for illustrating a process of merging buffered sheets with a succeeding sheet and conveying the sheets to the processing tray.

In a case where the number of buffered sheets is less by one than the number of sheets in the bundle of sheets to be subjected to the aligning processing at one time, another succeeding sheet is merged with the sheets Sh3 and Sh4 in the reverse path 90 illustrated in FIG. 12E to satisfy the necessary number, and the sheets are conveyed to the processing tray 51 (Step St15). For example, as illustrated in FIG. 13A, another succeeding sheet Sh5 is conveyed in the sheet carry-in passage 28, and the downstream leading edge of the sheet Sh5 enters the first sheet discharge path 30 to reach the position matching with the downstream edges of the previous succeeding sheets Sh3 and Sh4 at the buffer position. Then, the conveyance roller pair 91 is rotated to convey the previous succeeding sheets Sh3 and Sh4 from the reverse path 90 to the first sheet discharge path 30.

Figure 13B:
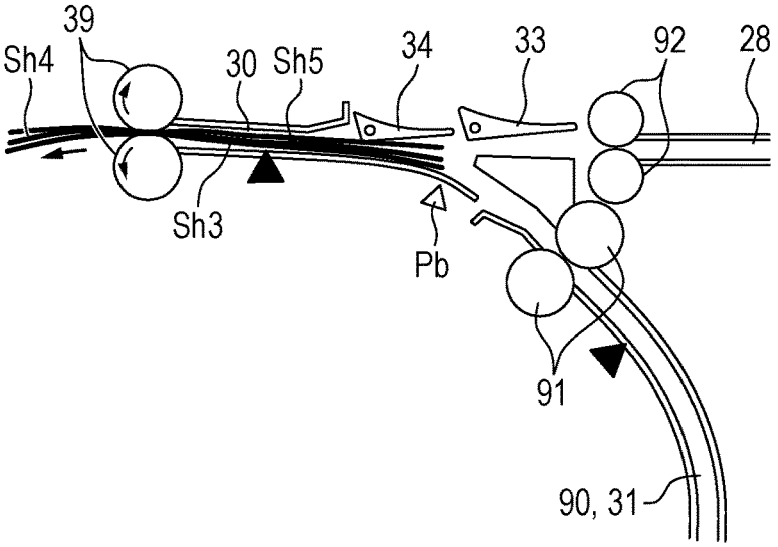
FIG. 13B is a schematic explanatory view for illustrating the process of merging the buffered sheets with the succeeding sheet and conveying the sheets to the processing tray.

In this embodiment, the last sheet Sh5 is conveyed at a speed higher than those of the sheets Sh3 and Sh4 in the reverse path 90. Thus, the downstream edge of the sheet Sh5 reaches the discharge roller pair 39, and is locked and stopped thereat. Then, the preceding sheets Sh3 and Sh4 having reached the discharge roller pair 39 later merge under a state of being overlaid in the first sheet discharge path 30. Next, when the discharge roller pair 39 is rotated toward the carry-out direction without being reversely rotated in course, as illustrated in FIG. 13B, the sheets Sh3, Sh4, and Sh5, which are aligned at the respective downstream edges, are nipped by the discharge roller pair 39 and conveyed onto the processing tray 51.

In this case, sufficient time can be secured as compared to the case where only the sheets Sh3 and Sh4 in the reverse path 90 are conveyed to the processing tray 51 before a sheet succeeding the last sheet Sh5 is conveyed in the sheet carry-in passage 28. Thus, the problems of hitting and the like, which may be caused when a sheet subsequently fed from the image forming apparatus A catches up in the first sheet discharge path 30, can more reliably be avoided.

As illustrated in FIG. 12A, a downstream portion of the succeeding sheet to be buffered significantly extends above the processing tray 51 from the sheet discharge port 35 at the time of the reversing operation by the discharge roller pair 39. Therefore, there is a case where the succeeding sheet to be buffered enters or passes through the processing operation range on the processing tray 51. At this time, when the sheet processing apparatus 37 is operated to perform processing on a sheet or a bundle of sheets placed on the processing tray 51, there is a fear in that the processing operation may interfere with the succeeding sheet to be buffered to hinder the conveyance of the sheet or cause damage on the sheet.

In this embodiment, as the case where the processing operation of the sheet processing apparatus 37 may interfere with the conveyance of the succeeding sheet to be buffered, the following processing is exemplified. As illustrated in FIG. 7C or FIG. 8C, there is provided processing of conveying the preceding sheet Sh1 or Sh2, which has been discharged onto the processing tray 51, to the position at which the trailing edge thereof in the carry-out direction is brought into contact with the sheet edge regulating members 76, and aligning the sheet in the carry-out direction. In this case, there is a fear in that an operation of a conveyance roller device 71 for the sheet carry-in mechanism 52 configured to deliver the sheet in the carry-in direction on the processing tray 51 may interfere with the succeeding sheet to be buffered.

Figure 14:
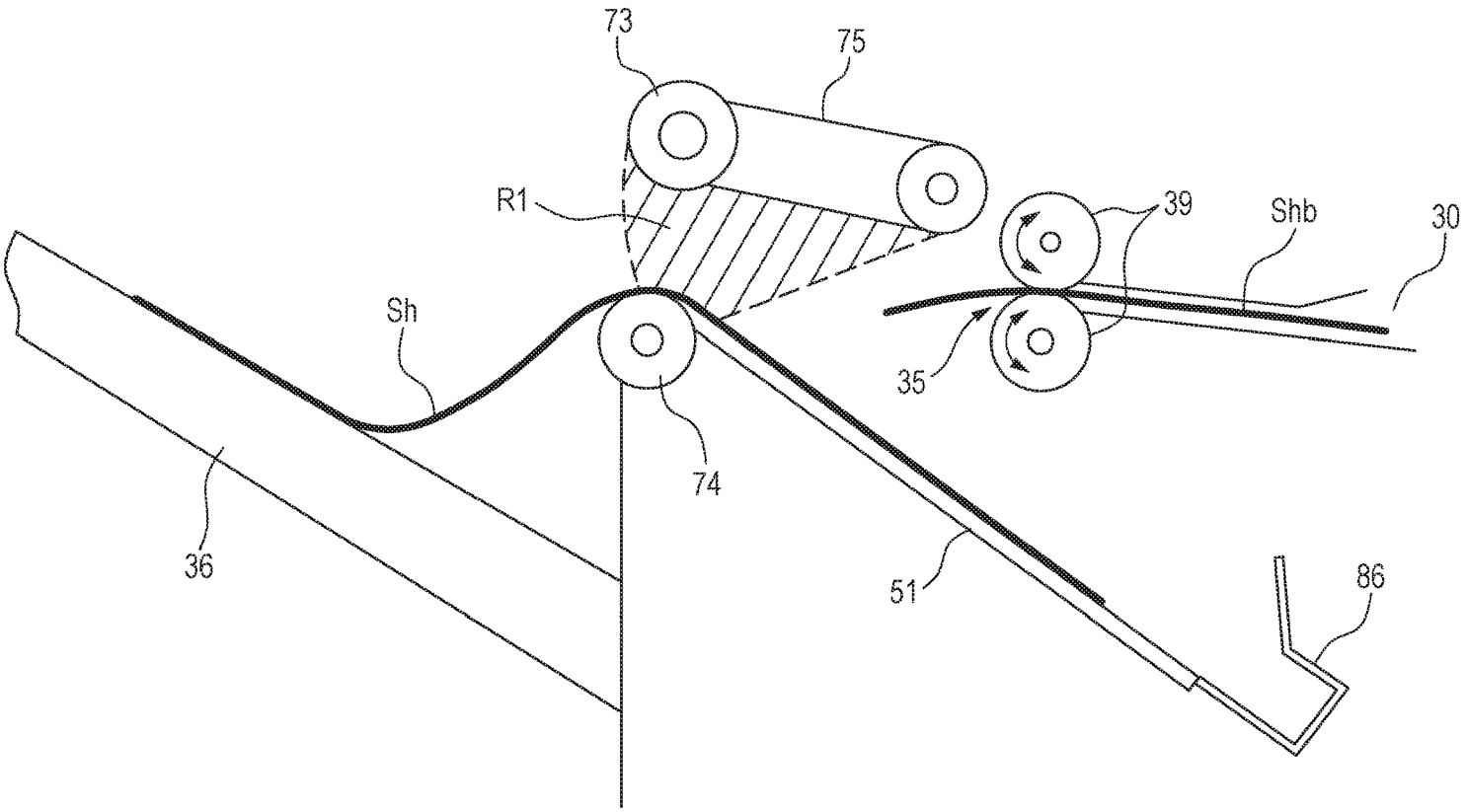
FIG. 14 is an explanatory view for illustrating a control on an operation of a sheet carry-in mechanism.
Figure 15:
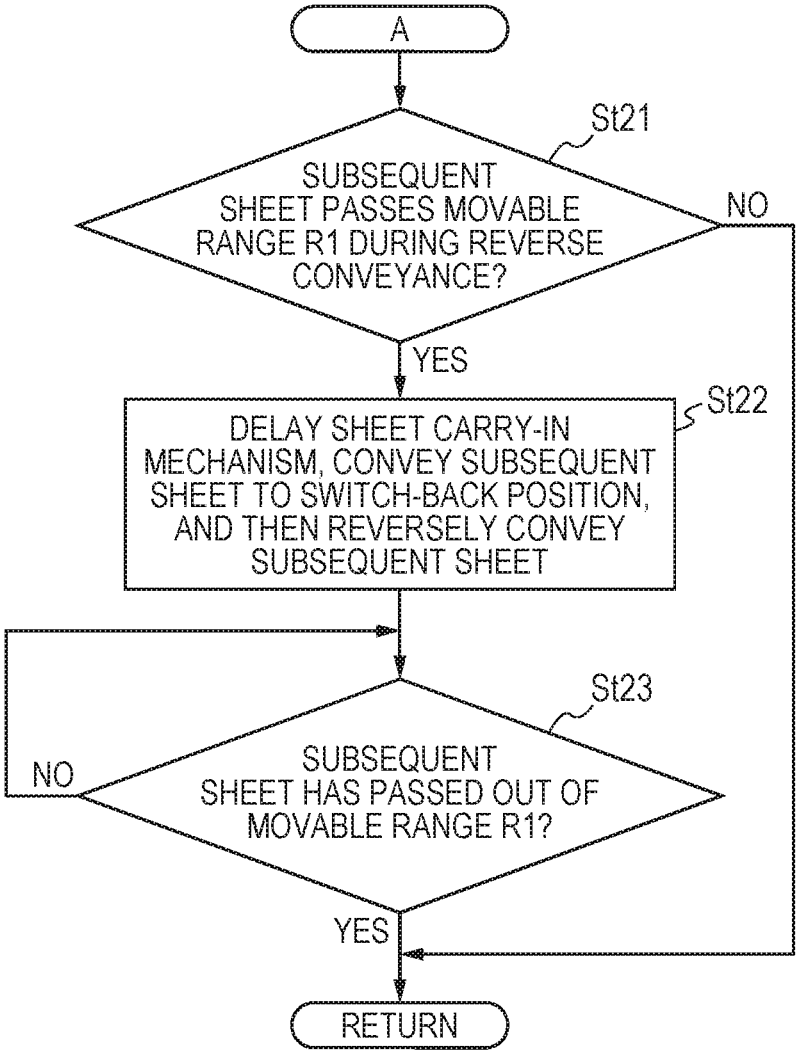
FIG. 15 is a flowchart for illustrating a process of reversely conveying a succeeding sheet after Step St1 or Step St4.

FIG. 14 is a view for illustrating a case where, after Step St1 or Step St4, under a state in which the preceding sheet Sh is discharged onto the processing tray 51 to extend over the stack tray 36 as illustrated in FIG. 7A, the succeeding sheet Shb to be buffered is reversely conveyed by the discharge roller pair 39. FIG. 15 is a flowchart for illustrating the process of reversely conveying the succeeding sheet Shb after Step St1 or Step St4. In this case, the downstream portion of the succeeding sheet Shb in the conveyance direction extends above the processing tray 51 from the sheet discharge port 35. When this portion is in a movable range R1 of the upper conveyance roller 73 and the vertically movable bracket 75 (processing portion) of the conveyance roller device 71, operations of the upper conveyance roller 73 and the vertically movable bracket 75 may interfere with the succeeding sheet Shb to be buffered.

The main body control portion 87 determines whether or not the succeeding sheet Shb passes through the movable range R1 of the upper conveyance roller 73 at the time of the reversing operation (Step St21). When the succeeding sheet Shb passes through the movable range R1, the operation of the sheet carry-in mechanism 52 is caused to delay from reaching the downstream edge of the succeeding sheet Shb in the carry-out direction the movable range R1 to passing the succeeding sheet Shb through and out of the movable range R1 (first mode). That is, the vertically movable bracket 75 is held in standby at an upper initial position illustrated in FIG. 14, and the lowering operation of allowing the upper conveyance roller 73 to be brought into contact with the upper surface of the sheet on the processing tray 51 is caused to delay (Step St22).

With this, during the reversing operation by the discharge roller pair 39, the succeeding sheet Shb to be buffered is reversely conveyed to the reverse path 90 at a predetermined conveyance speed without being hindered or being caused to delay. When it is determined that the succeeding sheet Shb has passed out of the movable range R1 (Step St23), the step proceeds to Step St2 or Step St5, and the trailing edge of the sheet Sh on the processing tray 51 in the carry-out direction is aligned.

In another embodiment, the main body control portion 87 causes the lowering operation of the vertically movable bracket 75 to be performed at low speed, thereby being capable of avoiding interference with the succeeding sheet Shb to be buffered. In this case, the lowering speed and the timing of starting lowering of the vertically movable bracket 75 are determined in consideration of a passing state of the succeeding sheet Shb in the movable range R1 based on a maximum extension length from the sheet discharge port 35, which is determined in advance from the size (length in carry-out direction) of the succeeding sheet Shb, and the sheet conveyance speed of the discharge roller pair 39.

In another embodiment, there is a case where a length of the succeeding sheet Shb in the carry-out direction is small, and it may be determined that, even when the downstream edge of the succeeding sheet Shb maximally extends from the sheet discharge port 35, the downstream edge does not reach the movable range R1 (Step St21). In this case, even when the upper conveyance roller and the vertically movable bracket 75 are operated, there is no fear of interference with the succeeding sheet Shb. Thus, the main body control portion 87 proceeds to Step St2 or Step St5 irrespective of the reversing operation of the succeeding sheet Shb. Then, as usual, the main body control portion 87 performs the aligning processing in the carry-out direction, lowers the vertically movable bracket 75 (second mode), rotates the upper conveyance roller 73, and conveys the sheet Sh on the processing tray 51 in the carry-in direction.

In this embodiment, as another case in which the processing operation of the sheet processing apparatus 37 may interfere with the conveyance of the succeeding sheet to be buffered, the following processing is exemplified. There are provided processing of, as illustrated in FIG. 8B and FIG. 9D, through use of the side alignment mechanism to perform alignment in the width direction with the trailing edge of the sheet Sh or Sh2 in the carry-out direction held in contact with the sheet edge regulating members 76, and offset processing of, as illustrated in FIG. 9E, moving the bundle of sheets Sb in the width direction. In those cases, there is a fear in that the operation of the side alignment members 77 of the side alignment mechanism configured to move the sheet or the bundle of sheets in the width direction on the processing tray 51 may interfere with the succeeding sheet to be buffered.

Figure 16A:
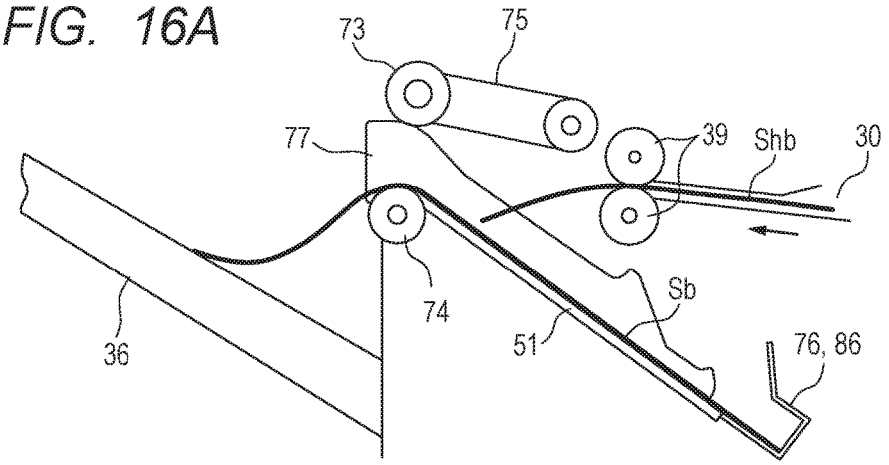
FIG. 16A is an explanatory view for illustrating a control on an operation of a side alignment mechanism.
Figure 16B:
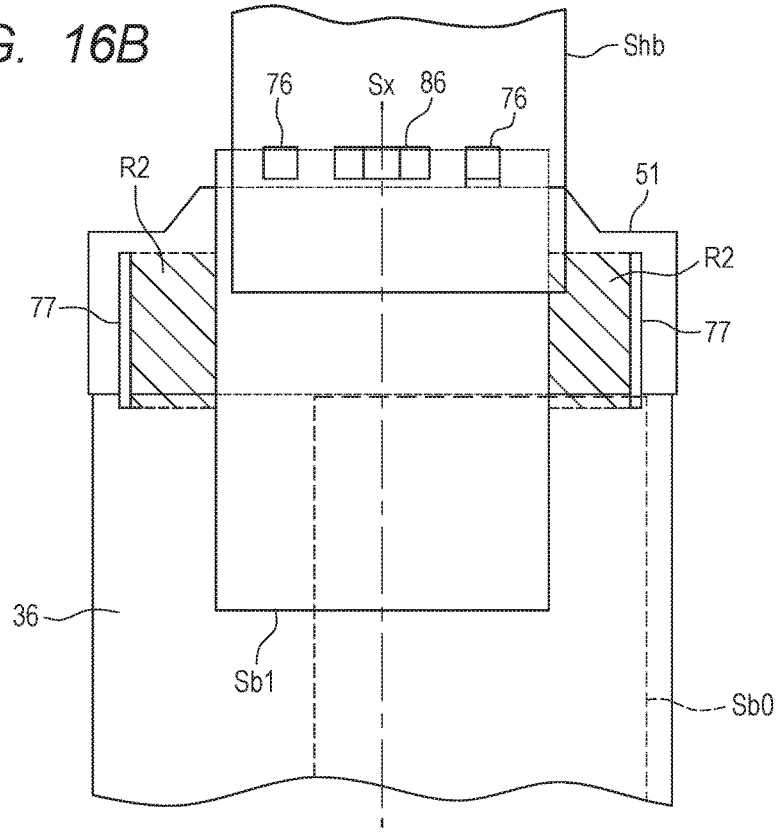
FIG. 16B is an explanatory view for illustrating the control on the operation of the side alignment mechanism.
Figure 17:
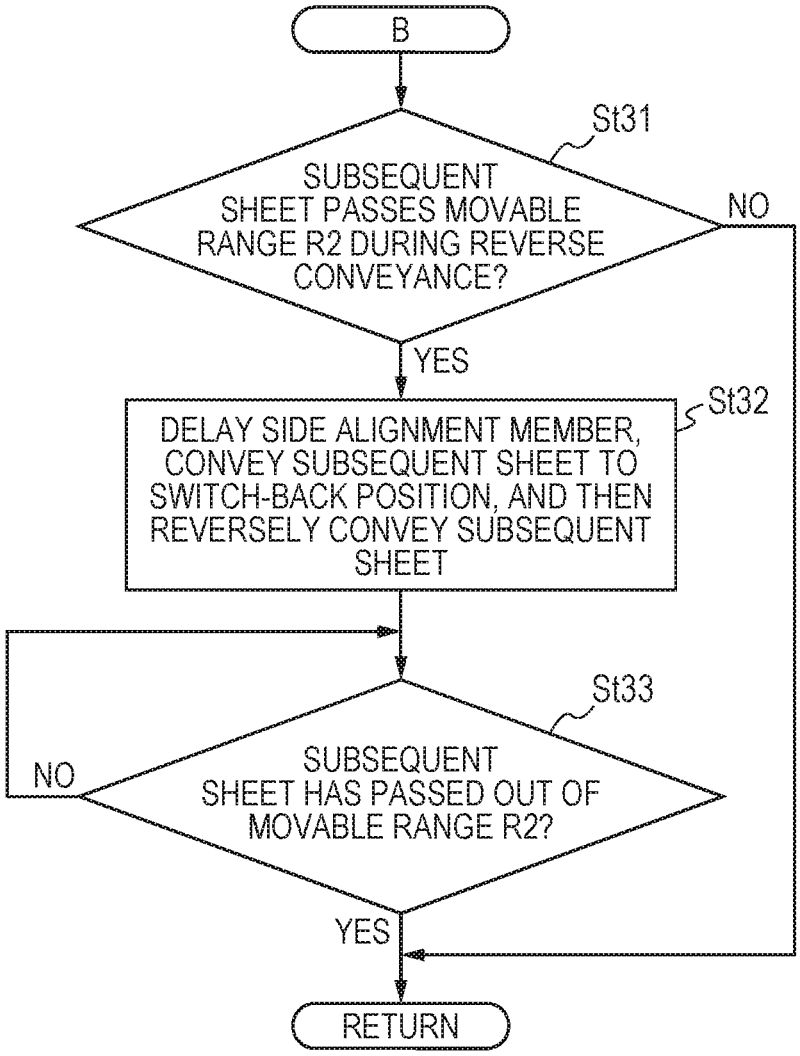
FIG. 17 is a flowchart for illustrating a process of reversely conveying a succeeding sheet after Step St2 or Step St5.

FIG. 16A and FIG. 16B are views for illustrating a case where, after Step St2 or Step St5, as illustrated in FIG. 7C and FIG. 8A, the succeeding sheet Shb is reversely conveyed under a state in which the trailing edge of the sheet Sh in the carry-out direction on the processing tray 51 is brought into contact with the sheet edge regulating members 76. The succeeding sheet Shb to be buffered is reversely conveyed by the discharge roller pair 39. FIG. 17 is a flowchart for illustrating the process of reversely conveying the succeeding sheet Shb after Step St2 or Step St5. In this case, the downstream portion of the succeeding sheet Shb in the conveyance direction extends above the processing tray 51 from the sheet discharge port 35. When that portion is in the movable range R2 of the side alignment members 77 (processing portion) configured to perform aligning processing on the sheet Sh, the operation of the side alignment members interferes with the downstream portion of the succeeding sheet Shb to be buffered in the conveyance direction.

The main body control portion 87 determines whether or not the succeeding sheet Shb passes through the movable range R2 of the side alignment members 77 at the time of the reversing operation (Step St31). When the succeeding sheet Shb passes through the movable range R2, the operation of the side alignment members 77 is caused to delay from reaching the downstream edge of the succeeding sheet Shb in the carry-out direction the movable range R2 of the side alignment members 77 to passing the succeeding sheet Shb through and out of the movable range R2 (first mode). The side alignment members 77 are held in standby at initial positions on right and left illustrated in FIG. 16B to cause the aligning processing by the side alignment mechanism to delay (Step St32).

With this, the succeeding sheet Shb to be buffered is reversely conveyed to the reverse path 90 at a predetermined conveyance speed without being hindered or caused to delay during the reversing operation by the discharge roller pair 39. When it is determined that the succeeding sheet Shb has passed out of the movable range R2 (Step St33), the step proceeds to Step St3 or Step St6, and alignment of the sheet Sh on the processing tray 51 in the width direction is performed.

In another embodiment of the present invention, the main body control portion 87 controls movement of the side alignment members 77 from the initial positions to the processing positions in contact with the both side edges of the sheet Sh to be performed at low speed. With this, interference with the succeeding sheet Shb to be buffered can be avoided. In this case, the moving speed of the side alignment members 77 and the timing of starting the movement are determined in consideration of the passing state of the succeeding sheet Shb through the movable range R2 based on the height of the side alignment members 77 from the processing tray 51, the maximum extension length from the sheet discharge port 35 determined in advance from the size of the succeeding sheet Shb (length in carry-out direction), and the sheet conveyance speed of the discharge roller pair 39.

In another embodiment, there is a case where the width dimension of the succeeding sheet Shb is small, and it is determined that, even when the downstream edge of the succeeding sheet Shb in the carry-out direction maximally extends from the sheet discharge port 35, the downstream edge is not included in the movable range R2 (Step St31). In this case, even when the side alignment members 77 are operated, there is no fear of interference with the succeeding sheet Shb. Thus, irrespective of the reversing operation of the succeeding sheet Shb, the main body control portion 87, as usual, controls the side alignment members 77 to move (second mode) to perform the aligning processing in the width direction.

In the case of the offset processing illustrated in FIG. 9E, the movable range of the side alignment members 77 is different from the movable range R2 in the aligning processing in the width direction. Also in this case, as describe above in relation to FIG. 14, the main body control portion 87 controls operations of the side alignment mechanism to avoid interference with the succeeding sheet Shb to be buffered.

Figure 18:
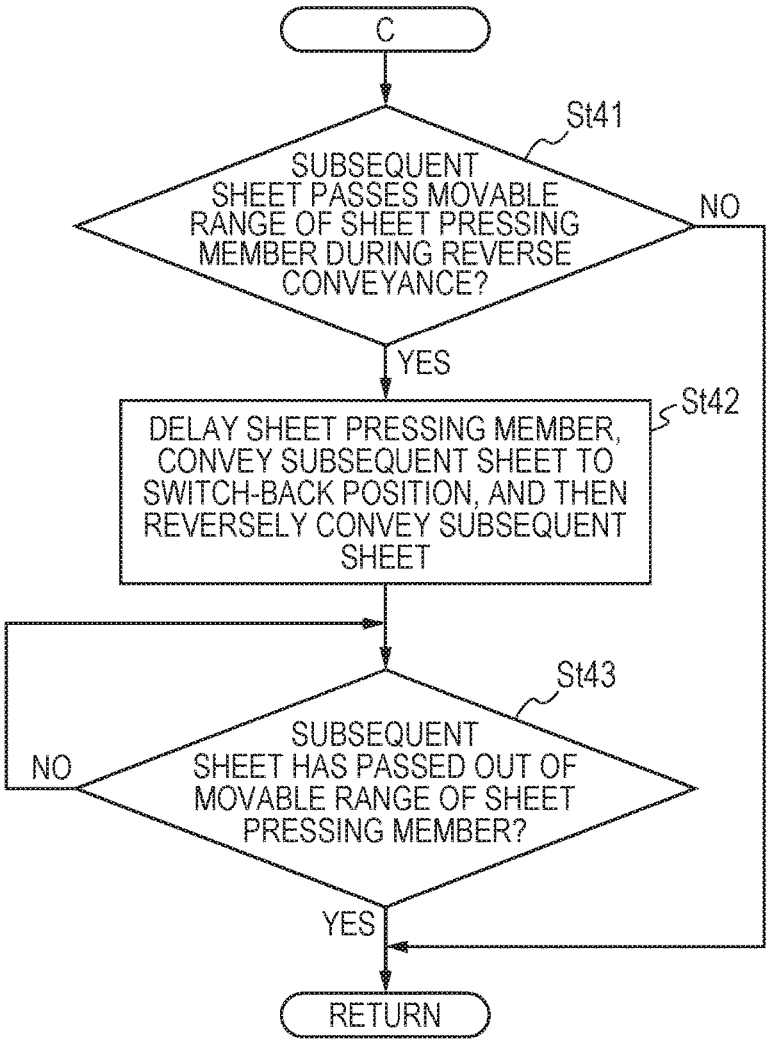
FIG. 18 is a flowchart for illustrating a process of reversely conveying a succeeding sheet after Step St7.
Figure 19:
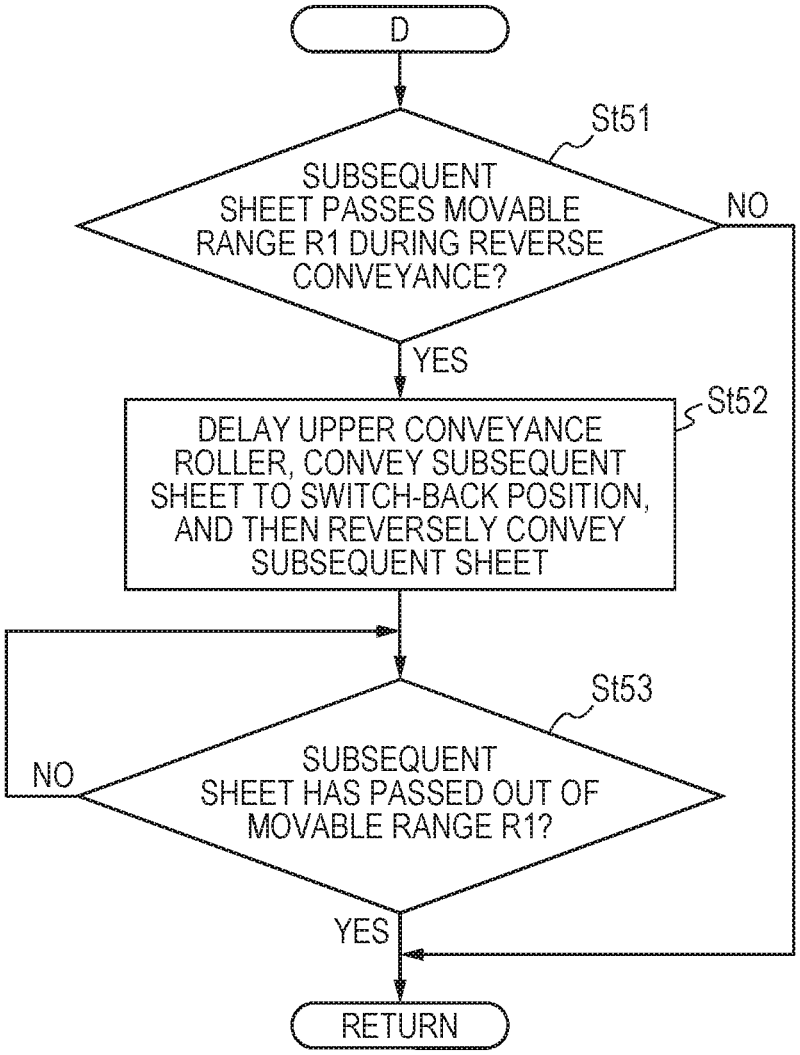
FIG. 19 is a flowchart for illustrating a process of reversely conveying a succeeding sheet after Step St8.

In this embodiment, as another case where the processing operation of the sheet processing apparatus 37 interferes with conveyance of the succeeding sheet to be buffered, the following processing is exemplified. After Step St7 or Step St8, as illustrated in FIG. 10B and FIG. 10C, there is provided processing of conveying the sheet or bundle of sheets on the processing tray 51 to the stack tray 36. FIG. 18 is a flowchart for illustrating a process of reversely conveying the succeeding sheet Shb after Step St7. FIG. 19 is a flowchart for illustrating a process of reversely conveying the succeeding sheet Shb after Step St8.

In those cases, in the movable range in which the sheet push-out member 86 moves from an upstream end position in the carry-out direction of FIG. 10A to the maximum push-out position of FIG. 10B, there is a fear of interference with the succeeding sheet Shb to be buffered. Further, as described above in relation to FIG. 14, the portion of the succeeding sheet Shb on downstream in the conveyance direction extends above the processing tray 51 from the sheet discharge port 35. When that portion is in the movable range of the sheet push-out member 86 (processing portion), the operation of the sheet push-out member 86 interferes with the succeeding sheet Shb to be buffered.

The main body control portion 87 determines whether or not the succeeding sheet Shb passes through the movable range of the sheet push-out member 86 at the time of the reversing operation (Step St41). When the succeeding sheet Shb passes through the movable range, the operation of the sheet push-out member 86 is caused to delay from reaching the downstream edge of the succeeding sheet Shb in the carry-out direction the movable range of the sheet push-out member 86 to passing the succeeding sheet Shb through and out of the movable range (first mode). That is, the sheet push-out member 86 is held in standby at the initial positions on an upstream end in the carry-out direction, and conveyance by the conveyor device 81 is caused to delay (Step St42).

With this, the succeeding sheet Shb to be buffered is reversely conveyed to the reverse path 90 at a predetermined conveyance speed without being hindered or caused to delay during the reversing operation by the discharge roller pair 39. When it is determined that the succeeding sheet Shb has passed out of the movable range of the sheet push-out member (Step St43), the step proceeds to Step St8. Then, the bundle of sheets Sb on the processing tray 51 is conveyed by the sheet push-out member 86 in the carry-out direction until the trailing edge of the bundle of sheets Sb reaches the maximum push-out position.

In FIG. 19, the main body control portion 87 determines whether or not the succeeding sheet Shb passes through the movable range R1 of the upper conveyance roller at the time of the reversing operation (Step St51). When the succeeding sheet Shb passes through the movable range R1, the operation of the upper conveyance roller 73 is caused to delay from reaching the downstream edge of the succeeding sheet Shb in the carry-out direction the movable range R1 to passing the succeeding sheet Shb through and out of the movable range. That is, the vertically movable bracket 75 is held in standby at an upper initial position illustrated in FIG. 14, and the lowering operation of allowing the upper conveyance roller 73 to come into contact with the upper surface of the sheet on the processing tray 51 is caused to delay (Step St52).

With this, the succeeding sheet Shb to be buffered is reversely conveyed to the reverse path 90 at a predetermined conveyance speed without being hindered or caused to delay during the reversing operation by the discharge roller pair 39. When it is determined that the succeeding sheet Shb has passed out of the movable range R1 of the upper conveyance roller 73 (Step St53), the step proceeds to Step St9 to allow the bundle of sheets Sb to be conveyed in the carry-out direction to the stack tray 36.

As described above in relation to FIG. 14, the main body control portion 87 causes timings of starting operations of the upper conveyance roller 73 and the vertically movable bracket 75 to delay, or decreases the operation speeds of those. With this, the interference with the upper conveyance roller 73 and the vertically movable bracket 75 can be avoided. Further, the portion of the succeeding sheet Shb on downstream in the conveyance direction, which extends above the processing tray 51 from the sheet discharge port 35, is in the moving range of from the upstream end position in the carry-out direction to the maximum push-out position of the sheet push-out member 86. During this time, the main body control portion 87 causes the timing of starting the operation of the sheet push-out member 86 to delay, or decreases the operation speed thereof. With this, the interference between the sheet push-out member 86 and the succeeding sheet Shb to be buffered can be similarly avoided.

This embodiment is applicable also to a case other than the case where the succeeding sheet Shb to be buffered is discharged from the processing tray 51 in the first processing portion B1 to the stack tray 36. That is, this embodiment is similarly applicable to the case where the succeeding sheet Shb is delivered to another processing portion of the sheet post-processing apparatus B after the succeeding sheet Shb is reversely conveyed by the discharge roller pair 39, or retained in the reverse path 90. Further, the succeeding sheet Shb to be discharged from the sheet discharge port 35 to the processing tray 51 can be directly conveyed by the conveyance rollers 73 and 74 to the stack tray 36 alone or together with the preceding sheet or bundle of sheets on the processing tray 51 without being subjected to the above-mentioned aligning processing.

In this embodiment, in order to process the sheet placed on the sheet placement portion by the processing portion, the speed or timing of moving the processing portion to the processing position is differentiated in accordance with the state at the time when the sheet conveyed in the sheet conveyance path passes the sheet placement portion. With this, the interference between the sheet and the processing portion at the sheet placement portion can be avoided. Accordingly, the fear in that the conveyance of the succeeding sheet conveyed on the sheet conveyance path is hindered by the processing portion for processing the preceding sheet placed on the sheet placement portion is eliminated. Thus, irrespective of the state of the processing portion of the sheet processing apparatus, the image forming apparatus can feed the sheet having image formed thereon to the sheet processing apparatus sequentially at the predetermined sheet discharging speed, thereby being capable of maintaining high productivity thereof.

The present invention has been described above with reference to the embodiments. However, it goes without saying that the present invention is not limited to those embodiments but may be carried out by adding various modifications and changes within the technical scope of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-031063, filed Feb. 22, 2016, which is hereby incorporated by reference herein in its entirety.

What is claimed is:

1. A sheet processing apparatus, comprising:

a conveyance portion which conveys a sheet in a conveyance direction and conveys the sheet in a direction opposite to the conveyance direction;

a placement portion to which a sheet conveyed by the conveyance portion in the conveyance direction is placed;

an alignment portion configured to perform alignment of a sheet placed on the placement portion in a sheet width direction intersecting the conveyance direction, and to be movable in a predetermined moving range; and a control portion configured to control the alignment portion and the conveyance portion, wherein the control portion causes the conveyance portion to convey a sheet which is positioned outside the predetermined moving range in the conveyance direction so as to position the sheet in the predetermined moving range, and causes the conveyance portion to convey the sheet which is positioned in the predetermined moving range in the direction opposite to the conveyance direction so as to position the sheet outside the predetermined moving range, wherein the control portion causes the alignment portion to be positioned at a first position that prevents the alignment portion from interfering with a sheet when the control portion causes the conveyance portion to position the sheet in the predetermined moving range, and wherein, after the control portion causes the conveyance portion to pass the sheet through the predetermined moving range and before the control portion causes the conveyance portion to position the sheet in the predetermined moving range again, the control portion causes the alignment portion to be positioned at a second position and to perform the alignment on a preceding sheet, which has been conveyed by the conveyance portion before the sheet and then been placed on the placement portion before the sheet, without performing the alignment on the sheet.

2. A sheet processing apparatus according to claim 1, further comprising a guide portion configured to guide the sheet, which has been conveyed by the conveyance portion in the direction opposite to the conveyance direction and has passed through the predetermined moving range.

3. A sheet processing apparatus according to claim 2, wherein the guide portion is capable of temporarily retaining a sheet.

4. A sheet processing apparatus according to claim 2, further comprising a conveyance path configured to guide the preceding sheet, which is conveyed by the conveyance portion in the conveyance direction and placed on the placement portion, wherein the guide portion branches out from the conveyance path.

5. A sheet processing apparatus according to claim 4, wherein the control portion sets a conveyance speed of a sheet on the guide portion to be lower than a conveyance speed of a sheet on the conveyance path.

6. A sheet processing apparatus according to claim 1, wherein the control portion is configured to execute:

a first mode of controlling the alignment portion to be positioned at the first position that prevents the alignment portion from interfering with the sheet conveyed by the conveying portion when the sheet is in the predetermined moving range, and to be positioned at the second position in which the alignment is performed on the preceding sheet without being performed on the sheet, and a second mode in which a time period from placing the preceding sheet on the placement portion to performing the alignment on the preceding sheet by the alignment portion is shorter than such a time period in the first mode.

7. A sheet processing apparatus according to claim 1, wherein the control portion is configured to execute:

a first mode of controlling the alignment portion to be positioned at the first position that prevents the alignment portion from interfering with the sheet conveyed by the conveying portion when the sheet is in the predetermined moving range, and to be positioned at the second position in which the alignment is performed on the preceding sheet without being performed on the sheet, and a second mode of setting a moving speed of the alignment portion to be higher than a moving speed in the first mode in a case that the alignment portion performs the alignment on the preceding sheet placed on the placement portion.

8. A sheet processing apparatus according to claim 1, wherein the control portion is configured to change, in accordance with a length in the conveyance direction of the sheet to be conveyed by the conveyance portion, a time period from placing the preceding sheet conveyed by the conveyance portion on the placement portion to performing the alignment on the preceding sheet by the alignment portion.

9. A sheet processing apparatus according to claim 1, wherein the control portion is configured to change, in accordance with a length in the conveyance direction of the sheet to be conveyed by the conveyance portion, a moving speed of the alignment portion for performing the alignment by the alignment portion on the preceding sheet conveyed by the conveyance portion.

10. An image forming system, comprising:

an image forming unit configured to form an image on a sheet; and a sheet processing apparatus configured to perform alignment of a sheet delivered from the image forming unit, wherein the sheet processing apparatus includes: a conveyance portion which conveys a sheet in a conveyance direction and conveys the sheet in a direction opposite to the conveyance direction; a placement portion to which a sheet conveyed by the conveyance portion in the conveyance direction is placed; an alignment portion configured to perform the alignment of a sheet placed on the placement portion in a sheet width direction intersecting the conveyance direction, and to be movable in a predetermined moving range; and a control portion configured to control the alignment portion and the conveyance portion, wherein the control portion causes the conveyance portion to convey a sheet which is positioned outside the predetermined moving range in the conveyance direction so as to position the sheet in the predetermined moving range, and causes the conveyance portion to convey the sheet which is positioned in the predetermined moving range in the direction opposite to the conveyance direction so as to position the sheet outside the predetermined moving range, wherein the control portion causes the alignment portion to be positioned at a first position that prevents the alignment portion from interfering with a sheet when the control portion causes the conveyance portion to position the sheet in the predetermined moving range, and wherein, after the control portion causes the conveyance portion to pass the sheet through the predetermined moving range and before the control portion causes the conveyance portion to position the sheet in the predetermined moving range again, the control portion causes the alignment portion to be positioned at a second position and to perform the alignment on a preceding sheet, which has been conveyed by the conveyance portion before the sheet and then been placed on the placement portion before the sheet, without performing the alignment on the sheet.

11. A sheet processing apparatus, comprising:

a conveyance portion which conveys a sheet in a conveyance direction and conveys the sheet in a direction opposite to the conveyance direction;

a placement portion to which a sheet conveyed by the conveyance portion in the conveyance direction is placed;

an alignment portion configured to perform alignment of a sheet placed on the placement portion in a sheet width direction intersecting the conveyance direction, and to be movable in a predetermined moving range; and a control portion configured to control the alignment portion and the conveyance portion, wherein the control portion causes the conveyance portion to convey a sheet which is positioned outside the predetermined moving range in the conveyance direction so as to position the sheet in the predetermined moving range, and causes the conveyance portion to convey the sheet which is positioned in the predetermined moving range in the direction opposite to the conveyance direction so as to position the sheet outside the predetermined moving range, wherein the control portion causes the alignment portion to be positioned at a first position that prevents the alignment portion from interfering with a sheet when the control portion causes the conveyance portion to position the sheet in the predetermined moving range, and wherein, after the control portion causes the conveyance portion to pass the sheet through the predetermined moving range, the control portion causes the alignment portion to be positioned at a second position and to perform the alignment on a preceding sheet, which has been conveyed by the conveyance portion before the sheet and then been placed on the placement portion, without performing the alignment on the sheet.

12. An image forming system, comprising:

an image forming unit configured to form an image on a sheet; and a sheet processing apparatus configured to perform alignment of a sheet delivered from the image forming unit, wherein the sheet processing apparatus includes: a conveyance portion which conveys a sheet in a conveyance direction and conveys the sheet in a direction opposite to the conveyance direction; a placement portion to which a sheet conveyed by the conveyance portion in the conveyance direction is placed; an alignment portion configured to perform the alignment of a sheet placed on the placement portion in a sheet width direction intersecting the conveyance direction, and to be movable in a predetermined moving range; and a control portion configured to control the alignment portion and the conveyance portion, wherein the control portion causes the conveyance portion to convey a sheet which is positioned outside the predetermined moving range in the conveyance direction so as to position the sheet in the predetermined moving range, and causes the conveyance portion to convey the sheet which is positioned in the predetermined moving range in the direction opposite to the conveyance direction so as to position the sheet outside the predetermined moving range, wherein the control portion causes the alignment portion to be positioned at a first position that prevents the alignment portion from interfering with a sheet when the control portion causes the conveyance portion to position the sheet in the predetermined moving range, and wherein, after the control portion causes the conveyance portion to pass the sheet through the predetermined moving range, the control portion causes the alignment portion to be positioned at a second position and to perform the alignment on a preceding sheet, which has been conveyed by the conveyance portion before the sheet and then been placed on the placement portion, without performing the alignment on the sheet.

13. A sheet processing apparatus, comprising:

a conveyance portion which conveys a sheet in a conveyance direction and conveys the sheet in a direction opposite to the conveyance direction;

a placement portion to which a sheet conveyed by the conveyance portion in the conveyance direction is placed;

an alignment portion configured to perform alignment of a sheet placed on the placement portion in a sheet width direction intersecting the conveyance direction, and to be movable in a predetermined moving range; and a control portion configured to control the alignment portion and the conveyance portion, wherein in a first case that the control portion causes the conveyance portion to convey a sheet which is positioned outside the predetermined moving range in the conveyance direction so as to position the sheet in the predetermined moving range, and causes the conveyance portion to convey the sheet which is positioned in the predetermined moving range in the direction opposite to the conveyance direction so as to position the sheet outside the predetermined moving range, (i) the control portion causes the alignment portion to be positioned at a first position that prevents the alignment portion from interfering with a sheet when the control portion causes the conveyance portion to position the sheet in the predetermined moving range, and (ii) after the control portion causes the conveyance portion to pass the sheet through the predetermined moving range and before the control portion causes the conveyance portion to position the sheet in the predetermined moving range again, the control portion causes the alignment portion to be positioned at a second position and to perform the alignment on a preceding sheet, which has been conveyed by the conveyance portion before the sheet and then been placed on the placement portion before the sheet, without performing the alignment on the sheet, and wherein in a second case that the control portion causes the conveyance portion to convey a sheet which is positioned outside the predetermined moving range in the conveyance direction so as to position the sheet in the predetermined moving range and then to discharge the sheet to the placement portion without causing the conveyance portion to convey the sheet which is positioned in the predetermined moving range in the direction opposite to the conveyance direction, a time period from (1) placing a preceding sheet, which has been conveyed by the conveyance portion before the sheet and then been placed on the placement portion before the sheet, on the placement portion to (2) performing the alignment on the preceding sheet by the alignment portion is shorter than such a time period in the first case.

* * * * *